US007826624B2

(12) United States Patent
Oxford

(10) Patent No.: US 7,826,624 B2
(45) **Date of Patent: *Nov. 2, 2010**

(54) SPEAKERPHONE SELF CALIBRATION AND BEAM FORMING

(75) Inventor: William V. Oxford, Austin, TX (US)

(73) Assignee: LifeSize Communications, Inc., Austin, TX (US)

( * ) Notice: Subject to any disclaimer, the term of this patent is extended or adjusted under 35 U.S.C. 154(b) by 1598 days.

This patent is subject to a terminal disclaimer.

(21) Appl. No.: 11/108,341

(22) Filed: Apr. 18, 2005

(65) Prior Publication Data

US 2006/0083389 A1 Apr. 20, 2006

Related U.S. Application Data

(60) Provisional application No. 60/619,303, filed on Oct. 15, 2004, provisional application No. 60/634,315, filed on Dec. 8, 2004.

(51) Int. Cl.
*H04R 3/00* (2006.01)

(52) U.S. Cl. ..... 381/92; 381/122; 381/58; 381/150

(58) Field of Classification Search ..... 381/92, 381/91, 122, 94.2, 94.3, 94.1, 71.1, 98, 113, 381/95, 96, 58, 59; 379/388.02, 388.01, 379/387.01

See application file for complete search history.

(56) References Cited

U.S. PATENT DOCUMENTS 3,963,868 A 6/1976 Randmere et al.
4,536,887 A 8/1985 Kaneda et al.
4,802,227 A 1/1989 Elko et al.
4,903,247 A 2/1990 Van Gerwen et al.

(Continued)

FOREIGN PATENT DOCUMENTS

JP 62203432 9/1987

(Continued)

OTHER PUBLICATIONS

Davis, et al., "A Subband Space Constrained Beamformer Incorporating Voice Activity Detection", IEEE International Conference on Acoustics, Speech, and Signal Processing 2005, Mar. 18-23, 2005, vol. 3, Philadelphia, PA, pp. iii/65-iii68.

(Continued)

*Primary Examiner*—Vivian Chin
*Assistant Examiner*—Con P Tran
(74) *Attorney, Agent, or Firm*—Meyertons Hood Kivlin Kowert & Goetzel, P.C.; Jeffrey C. Hood; Mark K. Brightwell

(57) ABSTRACT

A communication system includes a set of microphones, a speaker, memory and a processor. The processor is configured to operate on input signals from the microphones to obtain a resultant signal representing the output of a virtual microphone which is highly directed in a target direction. The processor also is configured for self calibration. The processor may provide an output signal for transmission from the speaker. The output signal may be a noise signal, or, a portion of a live conversation. The processor captures one or more input signals in response to the output signal transmission uses the output signal and input signals to estimate parameters of the speaker and/or microphone.

20 Claims, 8 Drawing Sheets

U.S. PATENT DOCUMENTS 5,029,162 A 7/1991 Epps
5,034,947 A 7/1991 Epps
5,051,799 A 9/1991 Paul et al.
5,054,021 A 10/1991 Epps
5,121,426 A 6/1992 Baumhauer, Jr. et al.
5,168,525 A 12/1992 Muller
5,263,019 A 11/1993 Chu
5,305,307 A 4/1994 Chu
5,335,011 A 8/1994 Addeo et al.
5,365,583 A 11/1994 Huang et al.
5,390,244 A 2/1995 Hinman et al.
5,396,554 A 3/1995 Hirano et al.
5,550,924 A 8/1996 Helf et al.
5,566,167 A 10/1996 Duttweiler
5,581,620 A 12/1996 Brandstein et al.
5,606,642 A 2/1997 Stautner et al.
5,617,539 A 4/1997 Ludwig et al.
5,649,055 A 7/1997 Gupta et al.
5,657,393 A 8/1997 Crow
5,664,021 A 9/1997 Chu et al.
5,689,641 A 11/1997 Ludwig et al.
5,715,319 A 2/1998 Chu
5,737,431 A 4/1998 Brandstein et al.
5,742,693 A 4/1998 Elko
5,751,338 A 5/1998 Ludwig, Jr.
5,778,082 A 7/1998 Chu et al.
5,787,183 A 7/1998 Chu et al.
5,793,875 A 8/1998 Lehr et al.
5,825,897 A 10/1998 Andrea et al.
5,844,994 A 12/1998 Graumann
5,896,461 A 4/1999 Faraci et al.
5,924,064 A 7/1999 Helf
5,983,192 A 11/1999 Botzko et al.
6,041,127 A 3/2000 Elko
6,049,607 A 4/2000 Marash et al.
6,072,522 A 6/2000 Ippolito et al.
6,130,949 A 10/2000 Aoki et al.
6,141,597 A 10/2000 Botzko et al.
6,173,059 B1 1/2001 Huang et al.
6,198,693 B1 3/2001 Marash
6,243,129 B1 6/2001 Deierling
6,246,345 B1 6/2001 Davidson et al.
6,317,501 B1 11/2001 Matsuo
6,351,238 B1 2/2002 Kishigami et al.
6,351,731 B1 2/2002 Anderson et al.
6,363,338 B1 3/2002 Ubale et al.
6,453,285 B1 9/2002 Anderson et al.
6,459,942 B1 10/2002 Markow et al.
6,469,732 B1 10/2002 Chang et al.
6,526,147 B1 2/2003 Rung
6,535,604 B1 3/2003 Provencal et al.
6,535,610 B1 3/2003 Stewart
6,566,960 B1 5/2003 Carver
6,584,203 B2 6/2003 Elko et al.
6,587,823 B1 7/2003 Kang et al.
6,590,604 B1 7/2003 Tucker et al.
6,593,956 B1 7/2003 Potts et al.
6,594,688 B2 7/2003 Ludwig et al.
6,615,236 B2 9/2003 Donovan et al.
6,625,271 B1 9/2003 O'Malley et al.
6,646,997 B1 11/2003 Baxley et al.
6,657,975 B1 12/2003 Baxley et al.
6,697,476 B1 2/2004 O'Malley et al.
6,721,411 B2 4/2004 O'Malley et al.
6,731,334 B1 5/2004 Maeng et al.
6,744,887 B1 6/2004 Berstein et al.
6,760,415 B2 7/2004 Beecroft
6,816,904 B1 11/2004 Ludwig et al.
6,822,507 B2 11/2004 Buchele
6,831,675 B2 12/2004 Shachar et al.
6,850,265 B1 2/2005 Strubbe et al.
6,856,689 B2 2/2005 Sudo et al.
6,912,178 B2 6/2005 Chu et al.
6,980,485 B2 12/2005 McCaskill
7,012,630 B2 3/2006 Curry et al.
7,130,428 B2 10/2006 Hirai et al.
7,133,062 B2 11/2006 Castles et al.
2002/0001389 A1* 1/2002 Amiri et al. ..... 381/56
2002/0123895 A1 9/2002 Potekhin et al.
2003/0053639 A1* 3/2003 Beaucoup et al. ..... 381/92
2003/0080887 A1* 5/2003 Havelock ..... 341/143
2003/0197316 A1 10/2003 Baumhauer, Jr. et al.
2004/0001137 A1 1/2004 Cutler et al.
2004/0010549 A1 1/2004 Matus et al.
2004/0032487 A1 2/2004 Chu et al.
2004/0032796 A1 2/2004 Chu et al.
2004/0183897 A1 9/2004 Kenoyer et al.
2005/0157866 A1 7/2005 Marton et al.
2005/0169459 A1 8/2005 Marton et al.
2005/0212908 A1 9/2005 Rodman et al.
2005/0262201 A1 11/2005 Rudolph et al.
2006/0013416 A1 1/2006 Truong et al.
2006/0034469 A1 2/2006 Tamiya et al.
2006/0109998 A1 5/2006 Michel
2006/0165242 A1 7/2006 Miki et al.

FOREIGN PATENT DOCUMENTS

JP 07264102 3/1994
JP 07135478 5/1995
JP 07240722 9/1995
JP 09307651 11/1997
JP 10190848 7/1998
WO WO 98/15945 4/1998
WO 9922460 5/1999
WO 2005064908 7/2005

OTHER PUBLICATIONS

Sawada, et al., "Blind Extraction of a Dominant Source Signal from Mixtures of Many Sources", IEEE International Conference on Acoustics, Speech, and Signal Processing 2005, Mar. 18-23, 2005, vol. 3, Philadelphia, PA, pp. iii/61-iii/64.

Vesa, et al., "Automatic Estimation of Reverberation Time from Binaural Signals", IEEE International Conference on Acoustics, Speech, and Signal Processing 2005, Mar. 18-23, 2005, vol. 3, Philadelphia, PA, pp. iii/281-iii/284.

Nomura, et al., "Linearization of Loudspeaker Systems Using Mint and Volterra Filters", IEEE International Conference on Acoustics, Speech, and Signal Processing 2005, Mar. 18-23, 2005, vol. 4, Philadelphia, PA, pp. iv/457-iv/460.

Chan, et al., "Theory and Design of Uniform Concentric Circular Arrays with Frequency Invariant Characteristics", IEEE International Conference on Acoustics, Speech, and Signal Processing 2005, Mar. 18-23, 2005, vol. 4, Philadelphia, PA, pp. iv/805-iv/808.

Warsitz, et al., "Acoustic Filter-and-Sum Beamforming by Adaptive Principal Component Analysis", IEEE International Conference on Acoustics, Speech, and Signal Processing 2005, Mar. 18-23, 2005, vol. 4, Philadelphia, PA, pp. iv/797-iv/800.

Santos, et al., "Spatial Power Spectrum Estimation Based on a MVDR-MMSE-MUSIC Hybrid Beamformer", IEEE International Conference on Acoustics, Speech, and Signal Processing 2005, Mar. 18-23, 2005, vol. 4, Philadelphia, PA, pp. iv/809-iv/812.

Yan, et al., "Design of FIR Beamformer with Frequency Invariant Patterns via Jointly Optimizing Spatial and Frequency Responses", IEEE International Conference on Acoustics, Speech, and Signal Processing 2005, Mar. 18-23, 2005, vol. 4, Philadelphia, PA, pp. iv/789-iv/792.

Bell, Kristine L., "MAP-PF Position Tracking with a Network of Sensor Arrays", IEEE International Conference on Acoustics, Speech, and Signal Processing 2005, Mar. 18-23, 2005, vol. 4, Philadelphia, PA, pp. iv/849-iv/852.

Yan, et al, "Cyclostationarity Based on DOA Estimation for Wideband Sources with a Conjugate Minimum-Redundancy Linear Array", IEEE International Conference on Acoustics, Speech, and Signal Processing 2005, Mar. 18-23, 2005, vol. 4, Philadelphia, PA, pp. iv/925-iv/928.
Belloni, et al., "Reducing Bias in Beamspace Methods for Uniform Circular Array", IEEE International Conference on Acoustics, Speech, and Signal Processing 2005, Mar. 18-23, 2005, vol. 4, Philadelphia, PA, pp. iv/973-iv/976.
Lau, et al., "Data-Adaptive Array Interpolation for DOA Estimation in Correlated Signal Environments", IEEE International Conference on Acoustics, Speech, and Signal Processing 2005, Mar. 18-23, 2005, vol. 4, Philadelphia, PA, pp. iv/945-iv/948.
Lau, et al, "Optimum Beamformers for Uniform Circular Arrays in a Correlated Signal Environment", IEEE International Conference on Acoustics, Speech, and Signal Processing 2000, vol. 5, pp. 3093-3096.
Cox, et al., "Practical Supergain", IEEE Transactions on Acoustics, Speech, and Signal Processing, vol. ASSP-34, No. 3, Jun. 1986, pp. 393-398.
Raabe, H. P., "Fast Beamforming with Circular Receiving Arrays", IBM Journal of Research and Development, vol. 20, No. 4, 1976, pp. 398-408.
Chu, Peter L., "Superdirective Microphone Array for a Set-Top Videoconferencing System", IEEE ASSP Workshop on applications of Signal Processing to Audio and Acoustics 1997, Oct. 19-22, 1997, 4 pages.
Do-Hong, et al., "Spatial Signal Processing for Wideband Beamforming", Proceedings of XII International Symposium on Theoretical Electrical Engineering 2003, Jul. 2003, pp. 73-76.
Haviland, R. P., "Supergain Antennas: Possibilities and Problems", IEEE Antennas and Propogation Magazine, vol. 37, No. 4, Aug. 1995, pp. 13-26.
Dandekar, et al., "Smart Antenna Array Calibration Procedure Including Amplitude and Phase Mismatch and Mutual Coupling Effects", IEEE International Conference on Personal Wireless Communications 2000, pp. 293-297.
De Abreu, et al., "A Modified Dolph-Chebyshev Approach for the Synthesis of Low Sidelobe Beampatterns with Adjustable Beamwidth", IEEE Transactions on Antennas and Propagation 2003, vol. 51, No. 10, Oct. 2003, pp. 3014-3017.
Lau, Buon Kiong, "Applications of Adaptive Antennas in Third-Generation Mobile Communications Systems: Chapter 5", Doctor of Philosophy Dissertation, Curtin University of Technology, Nov. 2002, 27 pages.
Chu, Peter L., "Quadrature Mirror Filter Design for an Arbitrary Number of Equal Bandwidth Channels", IEEE Transactions on Acoustics, Speech, and Signal Processing, vol. ASSP-33, No. 1, Feb. 1985, pp. 203-218.
Cao, et al., "An Auto Tracking Beamforming Microphone Array for Sound Recording", Audio Engineering Society, Fifth Australian Regional Convention, Apr. 26-28, 1995, Sydney, Australia, 9 pages.
Wang, et al., "Calibration, Optimization, and DSP Implementation of Microphone Array for Speech Processing", Workshop on VLSI Signal Processing, Oct. 30-Nov.1, 1996, pp. 221-230.
Zhang, et al., "Adaptive Beamforming by Microphone Arrays", IEEE Global Telecommunications Conference 1995, Nov. 14-16, 1995, pp. 163-167.
"Acoustics Abstracts", multi-science.co.uk, Jul. 1999, 115 pages.
"DSP in Loudspeakers", Journal of the Audio Engineering Society, vol. 52, No. 4, Apr. 2004, pp. 434-439.
Sanchez-Bote, et al., "Audible Noise Suppression with a Real-Time Broad-Band Superdirective Microphone Array", Journal of the Audio Engineering Society, vol. 53, No. 5, May 2005, pp. 403-418.
Klippel, Wolfgang, "Diagnosis and Remedy of Nonlinearities in Electrodynamical Transducers", 109th Audio Engineering Society Convention, Sep. 22-25, 2000, Los Angeles, CA, 38 pages.
Kuech, et al., "Nonlinear Acoustic Echo Cancellation Using Adaptive Orthogonalized Power Filters", IEEE International Conference on Acoustics, Speech, and Signal Processing 2005, Mar. 18-23, 2005, vol. 3, pp. iii/105-iii108.
Klippel, Wolfgang, "Dynamical Measurement of Non-Linear Parameters of Electrodynamical Loudspeakers and Their Interpretation", 88th Audio Engineering Society Convention, Mar. 13-16, 1990, 26 pages.
Tan, et al., "On the Application of Circular Arrays in Direction Finding: Part I: Investigation into the Estimation Algorithms", 1st Annual COST 273 Workshop, Espoo, Finland, May 29-30, 2002, pp. 1-8.
Pham, et al., "Wideband Array Processing Algorithms for Acoustic Tracking of Ground Vehicles", U.S. Army Research Laboratory, Proceedings of the 21st Army Science Conference, 1998, 9 pages.
Cevher, et al., "Tracking of Multiple Wideband Targets Using Passive Sensor Arrays and Particle Filters", Proceedings of the 10th IEEE Digital Signal Processing Workshop 2002 and Proceedings of the 2nd Signal Processing Education Workshop 2002, Oct. 13-16, 2002, pp. 72-77.
Kellerman, Walter, "Integrating Acoustic Echo Cancellation with Adaptive Beamforming Microphone Arrays", Forum Acusticum, Berlin, Mar. 14-19, 1999, 4 pages.
Porat, et al., "Accuracy requirements in off-line array calibration", IEEE Transactions on Aerospace and Electronic Systems, vol. 33, Issue 2, Part 1, Apr. 1997, pp. 545-556.
Haynes, Toby, "A Primer on Digital Beamforming", Spectrum Signal Processing, Mar. 26, 1998, pp. 1-15.
Friedlander, et al., "Direction Finding for Wide-Band Signals Using an Interpolated Array", IEEE Transactions on Signal Processings, vol. 41, No. 4, Apr. 1993, pp. 1618-1634.
Van Gerven, et al., "Multiple Beam Broadband Beamforming: Filter Design and Real-Time Implementation", IEEE ASSP Workshop on Applications of Signal Processing to Audio and Acoustics 1995, Oct. 15-18, 1995, pp. 173-176.
Tang, et al., "Optimum Design on Time Domain Wideband Beamformer with Constant Beamwidth for Sonar Systems", Oceans 2004, MTTS/IEEE TECHNO-OCEAN 2004, Nov. 9-12, 2004, vol. 2, pp. 626-630.
Pirinen, et al., "Time Delay Based Failure-Robust Direction of Arrival Estimation", Proceedings of the 3rd IEEE Sensor Array and Multichannel Signal Processing Workshop 2004, Jul. 18-21, 2004, pp. 618-622.
Dietrich, Jr., Carl B., "Adaptive Arrays and Diversity Antenna Configurations for Handheld Wireless Communication Terminals—Chapter 3: Antenna Arrays and Beamforming", Doctoral Dissertation, Virginia Tech, Feb. 15, 2005, 24 pages.
Valaee, Shahrokh, "Array Processing for Detection and Localization of Narrowband, Wideband and Distributed Sources—Chapter 4", Doctoral Dissertation, McGill University, Montreal, May 1994, 18 pages.
Chan, et al., "On the Design of Digital Broadband Beamformer for Uniform Circular Array with Frequency Invariant Characteristics", IEEE International Symposium on Circuits and Systems 2002, May 26-29, 2002, vol. 1, pp. I-693-I-696.
Orfanidis, Sophocles J., "Electromagnetic Waves and Antennas: Chapter 19—Array Design Methods", MATLAB, Feb. 2004, pp. 649-688.
Lau, Buon Kiong, "Applications of Adaptive Antennas in Third-Generation Mobile Communications Systems—Chapter 6: Optimum Beamforming", Doctoral Thesis, Curtin University, 2002, 15 pages.
Lau, et al., "Direction of Arrival Estimation in the Presence of Correlated Signals and Array Imperfections with Uniform Circular Arrays", Proceedings of the IEEE International Conference on Acoustics, Speech, and Signal Processing 2002, Aug. 7, 2002, vol. 3, pp. III-3037-III3040.
Goodwin, et al., "Constant Beamwidth Beamforming", Proceedings of the IEEE International Conference on Acoustics, Speech, and Signal Processing 1993, Apr. 27-30, 1993, vol. 1, pp. 169-172.
"MacSpeech Certifies Voice Tracker™ Array Microphone"; Apr. 20, 2005; 2 pages; MacSpeech Press.
"The Wainhouse Research Bulletin"; Apr. 12, 2006; 6 pages; vol. 7, #14.
"VCON Videoconferencing"; http://web.archive.org/web/20041012125813/http://www.itc.virginia.edu/netsys/videoconf/midlevel.html; 2004; 6 pages.
M. Berger and F. Grenez; "Performance Comparison of Adaptive Algorithms for Acoustic Echo Cancellation"; European Signal Processing Conference, Signal Processing V: Theories and Applications, 1990; pp. 2003-2006.

C.L. Dolph; "A current distribution for broadside arrays which optimizes the relationship between beam width and side-lobe level". Proceedings of the I.R.E. and Wave and Electrons; Jun. 1946; pp. 335-348; vol. 34.
M. Mohan Sondhi, Dennis R. Morgan and Joseph L. Hall; "Stereophonic Acoustic Echo Cancellation—An Overview of the Fundamental Problem"; IEEE Signal Processing Letters; Aug. 1995; pp. 148-151; vol. 2, No. 8.
Rudi Frenzel and Marcus E. Hennecke; "Using Prewhitening and Stepsize Control to Improve the Performance of the LMS Algorithm for Acoustic Echo Compensation"; IEEE International Symposium on Circuits and Systems; 1992; pp. 1930-1932.
Steven L. Gay and Richard J. Mammone; "Fast converging subband acoustic echo cancellation using RAP on the WE DSP16A"; International Conference on Acoustics, Speech, and Signal Processing; Apr. 1990; pp. 1141-1144.
Andre Gilloire and Martin Vetterli; "Adaptive Filtering in Subbands with Critical Sampling: Analysis, Experiments, and Application to Acoustic Echo Cancellation"; IEEE Transactions on Signal Processing, Aug. 1992; pp. 1862-1875; vol. 40, No. 8.
Andre Gilloire; "Experiments with Sub-band Acoustic Echo Cancellers for Teleconferencing"; IEEE International Conference on Acoustics, Speech, and Signal Processing; Apr. 1987; pp. 2141-2144; vol. 12.
Henry Cox, Robert M. Zeskind and Theo Kooij; "Practical Supergain", IEEE Transactions on Acoustics, Speech, and Signal Processing; Jun. 1986; pp. 393-398.
Walter Kellermann; "Analysis and design of multirate systems for cancellation of acoustical echoes"; International Conference on Acoustics, Speech, and Signal Processing, 1988 pp. 2570-2573; vol. 5.
Lloyd Griffiths and Charles W. Jim; "An Alternative Approach to Linearly Constrained Adaptive Beamforming"; IEEE Transactions on Antennas and Propagation; Jan. 1982; pp. 27-34; vol. AP-30, No. 1.
B. K. Lau and Y. H. Leung; "A Dolph-Chebyshev Approach to the Synthesis of Array Patterns for Uniform Circular Arrays" International Symposium on Circuits and Systems; May 2000; 124-127; vol. 1.
C. M. Tan, P. Fletcher, M. A. Beach, A. R. Nix, M. Landmann and R. S. Thoma; "On the Application of Circular Arrays in Direction Finding Part I: Investigation into the estimation algorithms", 1st Annual COST 273 Workshop, May/Jun. 2002; 8 pages.
Ivan Tashev; Microsoft Array project in MSR: approach and results, http://research.microsoft.com/users/ivantash/Documents/MicArraysInMSR.pdf; Jun. 2004; 49 pages.
Hiroshi Yasukawa, Isao Furukawa and Yasuzou Ishiyama; "Acoustic Echo Control for High Quality Audio Teleconferencing"; International Conference on Acoustics, Speech, and Signal Processing; May 1989; pp. 2041-2044; vol. 3.
Hiroshi Yasukawa and Shoji Shimada; "An Acoustic Echo Canceller Using Subband Sampling and Decorrelation Methods"; IEEE Transactions On Signal Processing; Feb. 1993; pp. 926-930; vol. 41, Issue 2.
"Press Releases"; Retrieved from the Internet: http://www.acousticmagic.com/press/; Mar. 14, 2003—Jun. 12, 2006; 18 pages; Acoustic Magic.
Marc Gayer, Markus Lohwasser and Manfred Lutzky; "Implementing MPEG Advanced Audio Coding and Layer-3 encoders on 32-bit and 16-bit fixed-point processors"; Jun. 25, 2004; 7 pages; Revision 1.11; Fraunhofer Institute for Integrated Circuits IIS; Erlangen, Germany.
Man Mohan Sondhi and Dennis R. Morgan; "Acoustic Echo Cancellation for Stereophonic Teleconferencing"; May 9, 1991; 2 pages; AT&T Bell Laboratories, Murray Hill, NJ.
Williams, et al., "A Digital Approach to Actively Controlling Inherent Nonlinearities of Low Frequency Loudspeakers", 87th Audio Engineering Society Convention, Oct. 18-21, 1989, New York, 12 pages.
Gao, et al., "Adaptive Linearization of a Loudspeaker", 93rd Audio Engineering Society Convention, Oct. 1-4, 1992, 16 pages.
Hall, David S., "Design Considerations for an Accelerometer-Based Loudspeaker Motional Feedback System", 87th Audio Engineering Society Convention, Oct. 18-21, 1989, New York, 15 pages.
Klippel, Wolfgang, "The Mirror Filter—A New Basis for Linear Equalization and Nonlinear Distortion Reduction of Woofer Systems", 92nd Audio Engineering Society Convention, Mar. 24-27, 1992, 49 pages.
Heed, et al., "Qualitative Analysis of Component Nonlinearities which Cause Low Frequency THD", 100th Audio Engineering Society Convention, May 11-14, 1996, Copenhagen, 35 pages.
Bright, Andrew, "Simplified Loudspeaker Distortion Compensation by DSP", Audio Engineering Society 23rd International Convention, Copenhagen, May 23-25, 2003, 11 pages.
Stahl, Karl Erik, "Synthesis of Loudspeaker Mechanical Parameters by Electrical Means: A new method for controlling low frequency loudspeaker behavior", 61st Audio Engineering Society Convention, Nov. 3-6, 1978, 18 pages.
Hawksford, M.O.J., "System measurement and modeling using pseudo-random filtered noise and music sequences", 114th Audio Engineering Society Convention, Mar. 22-25, 2003, Amsterdam, Holland, 21 pages.
Kaizer, A.J.M., "The Modelling of the Nonlinear Response of an Electrodynamic Loudspeaker by a Volterra Series Expansion", 80th Audio Engineering Society Convention, Mar. 4-7, 1986, Montreux, Switzerland, 23 pages.
Small, Richard H., "Loudspeaker Large-Signal Limitations", 1984 Australian Regional Convention, Sep. 25-27, 1984, Melbourne, 33 pages.
Katayama, et al., "Reduction of Second Order Non-Linear Distortion of a Horn Loudspeaker by a Volterra Filter—Real-Time Implementation", 103rd Audio Engineering Society Convention, Sep. 26-29, 1997, New York, 20 pages.
Merimaa, et al., "Concert Hall Impulse Responses—Pori, Finland: Analysis Results", Helsinki University of Technology, 2005, pp. 1-28.
Farina, Angelo, "Simultaneous Measurement of Impulse and Distortion with a Swept-Sine Technique", 108th Audio Engineering Society Convention, Feb. 19-22, 2000, Paris, 25 pages.
Ruser, et al., "The Model of a Highly Directional Microphone", 94th Audio Engineering Society Convention, Mar. 16-19, 1993, Berlin, 15 pages.
Greenfield, et al, "Efficient Filter Design for Loudspeaker Equalization", Journal of the Audio Engineering Society 1993, vol. 41, Issue 5, May 1993, pp. 364-366.
Ioannides, et al., "Uniform Circular Arrays for Smart Antennas", IEEE Antennes and Propagation Magazine, vol. 47, No. 4, Aug. 2005, pp. 192-208.
Di Claudio, Elio D., "Asymptotically Perfect Wideband Focusing of Multiring Circular Arrays", IEEE Transactions on Signal Processing, vol. 53, No. 10, Oct. 2005, pp. 3661-3673.
Griesinger, David, "Beyond MLS—Occupied hall measurement with FFT techniques", 101st Audio Engineering Society Convention, Nov. 1996, Waltham, MA, 23 pages.
"A history of video conferencing (VC) technology" http://web.archive.org/web/20030622161425/http://myhome.hanafos.com/~soonjp/vchx.html (web archive dated Jun. 22, 2003); 5 pages.
"MediaMax Operations Manual"; May 1992; 342 pages; VideoTelecom; Austin, TX.
"MultiMax Operations Manual"; Nov. 1992; 135 pages; VideoTelecom; Austin, TX.
Ross Cutler, Yong Rui, Anoop Gupta, JJ Cadiz, Ivan Tashev, Li-Wei He, Alex Colburn, Zhengyou Zhang, Zicheng Liu and Steve Silverberg; "Distributed Meetings: A Meeting Capture and Broadcasting System"; Multimedia '02; Dec. 2002; 10 pages; Microsoft Research; Redmond, WA.
P. H. Down; "Introduction to Videoconferencing"; http://www.video.ja.net/intro/; 2001; 26 pages.
"Polycom Executive Collection"; Jun. 2003; 4 pages; Polycom, Inc.; Pleasanton, CA.
Joe Duran and Charlie Sauer; "Mainstream Videoconferencing—A Developer's Guide to Distance Multimedia"; Jan. 1997; pp. 235-238; Addison Wesley Longman, Inc.

W. Herbordt, S. Nakamura, and W. Kellermann; "Joint Optimization of LCMV Beamforming and Acoustic Echo Cancellation for Automatic Speech Recognition"; ICASSP 2005; 4 pages.
Ivan Tashev and Henrique S. Malvar; "A New Beamformer Design Algorithm for Microphone Arrays"; ICASSP 2005; 4 pages.
Swen Muller and Paulo Massarani; "Transfer-Function Measurement with Sweeps"; Originally published in J. AES, Jun. 2001; 55 pages.

* cited by examiner

SPEAKERPHONE SELF CALIBRATION AND BEAM FORMING

PRIORITY CLAIM

This application claims the benefit of priority to U.S. Provisional Application No. 60/619,303, filed on Oct. 15, 2004, entitled "Speakerphone", invented by William V. Oxford, Michael L. Kenoyer and Simon Dudley, which is hereby incorporated by reference in its entirety.

This application claims the benefit of priority to U.S. Provisional Application No. 60/634,315, filed on Dec. 8, 2004, entitled "Speakerphone", invented by William V. Oxford, Michael L. Kenoyer and Simon Dudley, which is hereby incorporated by reference in its entirety.

BACKGROUND OF THE INVENTION

1. Field of the Invention

The present invention relates generally to the field of communication devices and, more specifically, to speakerphones.

2. Description of the Related Art

Speakerphones are used in many types of telephone calls, and particularly are used in conference calls where multiple people are located in a single room. A speakerphone may have a microphone to pick up voices of in-room participants, and, at least one speaker to audibly present voices from offsite participants. While speakerphones may allow several people to participate in a conference call on each end of the conference call, there are a number of problems associated with the use of speakerphones.

As the microphone and speaker age, their physical properties change, thus compromising the ability to perform high quality acoustic echo cancellation. Thus, there exists a need for a system and method capable of estimating descriptive parameters for the speaker and the microphone as they age.

Furthermore, noise sources such as fans, electrical appliances and air conditioning interfere with the ability to discern the voices of the conference participants. Thus, there exists a need for a system and method capable of "tuning in" on the voices of the conference participants and "tuning out" the noise sources.

SUMMARY

In one set of embodiments, a system (e.g., a speakerphone or a videoconferencing system) may include a microphone, a speaker, memory and a processor. The memory may be configured to store program instructions and data. The processor is configured to read and execute the program instructions from the memory. The program instructions are executable by the processor to:

(a) output a stimulus signal for transmission from the speaker;
(b) receive an input signal from the microphone;
(c) compute a midrange sensitivity and a lowpass sensitivity for a spectrum of the input signal;
(d) subtract the midrange sensitivity from the lowpass sensitivity to obtain a speaker-related sensitivity;
(e) perform an iterative search for current values of parameters of an input-output model for the speaker using the input signal spectrum, a spectrum of the stimulus signal, the speaker-related sensitivity; and
(f) update averages of the parameters of the speaker input-output model using the current values obtained in (e).

The parameter averages of the speaker input-output model are usable to perform echo cancellation on other input signals.

The input-output model of the speaker may be a nonlinear model, e.g., a Volterra series model.

The stimulus signal may be a noise signal, e.g., a burst of maximum-length-sequence noise.

Furthermore, the program instructions may be executable by the processor to:

perform an iterative search for a current transfer function of the microphone using the input signal spectrum, the spectrum of the stimulus signal, and the current parameter values; and update an average microphone transfer function using the current transfer function.

The average transfer function may also be usable to perform said echo cancellation on said other input signals.

In another set of embodiments, a method for performing self calibration may involve:

(a) outputting a stimulus signal (e.g., a noise signal) for transmission from a speaker;
(b) receiving an input signal from a microphone;
(c) computing a midrange sensitivity and a lowpass sensitivity for a spectrum of the input signal;
(d) subtracting the midrange sensitivity from the lowpass sensitivity to obtain a speaker-related sensitivity;
(e) performing an iterative search for current values of parameters of an input-output model for the speaker using the input signal spectrum, a spectrum of the stimulus signal, the speaker-related sensitivity; and
(f) updating averages of the parameters of the speaker input-output model using the current values obtained in (e).

The parameter averages of the speaker input-output model are usable to perform echo cancellation on other input signals.

The input-output model of the speaker may be a nonlinear model, e.g., a Volterra series model.

In yet another set of embodiments, a system (e.g., a speakerphone or a videoconferencing system) may include a microphone, a speaker, memory and a processor. The memory may be configured to store program instructions and data. The processor is configured to read and execute the program instructions from the memory. The program instructions are executable by the processor to:

(a) provide an output signal for transmission from the speaker, wherein the output signal carries live signal information from a remote source;
(b) receive an input signal from the microphone;
(c) compute a midrange sensitivity and a lowpass sensitivity for a spectrum of the input signal;
(d) subtract the midrange sensitivity from the lowpass sensitivity to obtain a speaker-related sensitivity;
(e) perform an iterative search for current values of parameters of an input-output model for the speaker using the input signal spectrum, a spectrum of the output signal, the speaker-related sensitivity; and
(f) update averages of the parameters of the speaker input-output model using the current values obtained in (e).

The parameter averages of the speaker input-output model are usable to perform echo cancellation on other input signals.

The input-output model of the speaker is a nonlinear model, e.g., a Volterra series model.

Furthermore, the program instructions may be executable by the processor to:

perform an iterative search for a current transfer function of the microphone using the input signal spectrum, the spectrum of the output signal, and the current parameter values; and update an average microphone transfer function using the current transfer function.

The current transfer function is usable to perform said echo cancellation on said other input signals.

In yet another set of embodiments, a method for performing self calibration may involve:

(a) providing an output signal for transmission from a speaker, wherein the output signal carries live signal information from a remote source;

(b) receiving an input signal from a microphone;

(c) computing a midrange sensitivity and a lowpass sensitivity for a spectrum of the input signal;

(d) subtracting the midrange sensitivity from the lowpass sensitivity to obtain a speaker-related sensitivity;

(e) performing an iterative search for current values of parameters of an input-output model for the speaker using the input signal spectrum, a spectrum of the output signal, the speaker-related sensitivity; and (f) updating averages of the parameters of the speaker input-output model using the current values obtained in (e).

The parameter averages of the speaker input-output model are usable to perform echo cancellation on other input signals.

Furthermore, the method may involve:

performing an iterative search for a current transfer function of the microphone using the input signal spectrum, the spectrum of the output signal, and the current values; and updating an average microphone transfer function using the current transfer function.

The current transfer function is also usable to perform said echo cancellation on said other input signals.

In yet another set of embodiments, a system may include a set of microphones, memory and a processor. The memory is configured to store program instructions and data. The processor is configured to read and execute the program instructions from the memory. The program instructions are executable by the processor to:

(a) receive an input signal corresponding to each of the microphones;

(b) transform the input signals into the frequency domain to obtain respective input spectra;

(c) operate on the input spectra with a set of virtual beams to obtain respective beam-formed spectra, wherein each of the virtual beams is associated with a corresponding frequency range and a corresponding subset of the input spectra, wherein each of the virtual beams operates on portions of input spectra of the corresponding subset of input spectra which have been band limited to the corresponding frequency range, wherein the virtual beams include one or more low end beams and one or more high end beams, wherein each of the low end beams is a beam of a corresponding integer order, wherein each of the high end beams is a delay-and-sum beam;

(d) compute a linear combination of the beam-formed spectra to obtain a resultant spectrum; and (e) inverse transform the resultant spectrum to obtain a resultant signal.

The program instructions are also executable by the processor to provide the resultant signal to a communication interface for transmission.

The set of microphones may be arranged in a circular array.

In yet another set of embodiments, a method for beam forming may involve:

(a) receiving an input signal from each microphone in set of microphones;

(b) transforming the input signals into the frequency domain to obtain respective input spectra;

(c) operating on the input spectra with a set of virtual beams to obtain respective beam-formed spectra, wherein each of the virtual beams is associated with a corresponding frequency range and a corresponding subset of the input spectra, wherein each of the virtual beams operates on portions of input spectra of the corresponding subset of input spectra which have been band limited to the corresponding frequency range, wherein the virtual beams include one or more low end beams and one or more high end beams, wherein each of the low end beams is a beam of a corresponding integer order, wherein each of the high end beams is a delay-and-sum beam;

(d) computing a linear combination of the beam-formed spectra to obtain a resultant spectrum; and (e) inverse transforming the resultant spectrum to obtain a resultant signal.

The resultant signal may be provided to a communication interface for transmission (e.g., to a remote speakerphone).

The set of microphones may be arranged in a circular array.

In yet another set of embodiments, a system may include a set of microphones, memory and a processor. The memory is configured to store program instructions and data. The processor is configured to read and execute the program instructions from the memory. The program instructions are executable by the processor to:

(a) receive an input signal from each of the microphones;

(b) operate on the input signals with a set of virtual beams to obtain respective beam-formed signals, wherein each of the virtual beams is associated with a corresponding frequency range and a corresponding subset of the input signals, wherein each of the virtual beams operates on versions of the input signals of the corresponding subset of input signals which have been band limited to the corresponding frequency range, wherein the virtual beams include one or more low end beams and one or more high end beams, wherein each of the low end beams is a beam of a corresponding integer order, wherein each of the high end beams is a delay-and-sum beam; and (c) compute a linear combination of the beam-formed signals to obtain a resultant signal.

The program instructions are executable by the processor to provide the resultant signal to a communication interface for transmission.

The set of microphones may be arranged in a circular array.

In yet another set of embodiments, a method for beam forming may involve:

(a) receiving an input signal from each microphone in a set of microphones;

(b) operating on the input signals with a set of virtual beams to obtain respective beam-formed signals, wherein each of the virtual beams is associated with a corresponding frequency range and a corresponding subset of the input signals, wherein each of the virtual beams operates on versions of the input signals of the corresponding subset of input signals which have been band limited to the corresponding frequency range, wherein the virtual beams include one or more low end beams and one or more high end beams, wherein each of the low end beams is a beam of a corresponding integer order, wherein each of the high end beams is a delay-and-sum beam; and (c) computing a linear combination of the beam-formed signals to obtain a resultant signal.

The resultant signal may be provided to a communication interface for transmission (e.g., to a remote speakerphone)

The set of microphones are arranged in a circular array. .

BRIEF DESCRIPTION OF THE DRAWINGS

The following detailed description makes reference to the accompanying drawings, which are now briefly described.

While the invention is described herein by way of example for several embodiments and illustrative drawings, those skilled in the art will recognize that the invention is not limited to the embodiments or drawings described. It should be understood, that the drawings and detailed description thereto are not intended to limit the invention to the particular form disclosed, but on the contrary, the intention is to cover all modifications, equivalents and alternatives falling within the spirit and scope of the present invention as defined by the appended claims. The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including, but not limited to.

DETAILED DESCRIPTION OF THE PREFERRED EMBODIMENTS

| List of Acronyms Used Herein | |
|---|---|
| DDR SDRAM = | Double-Data-Rate Synchronous Dynamic RAM |
| DRAM = | Dynamic RAM |

-continued

| List of Acronyms Used Herein | |
|---|---|
| FIFO = | First-In First-Out Buffer |
| FIR = | Finite Impulse Response |
| FFT = | Fast Fourier Transform |
| Hz = | Hertz |
| IIR = | Infinite Impulse Response |
| ISDN = | Integrated Services Digital Network |
| kHz = | kiloHertz |
| PSTN = | Public Switched Telephone Network |
| RAM = | Random Access Memory |
| RDRAM = | Rambus Dynamic RAM |
| ROM = | Read Only Memory |
| SDRAM = | Synchronous Dynamic Random Access Memory |
| SRAM = | Static RAM |

Speakerphone Block Diagram

Figure 1:
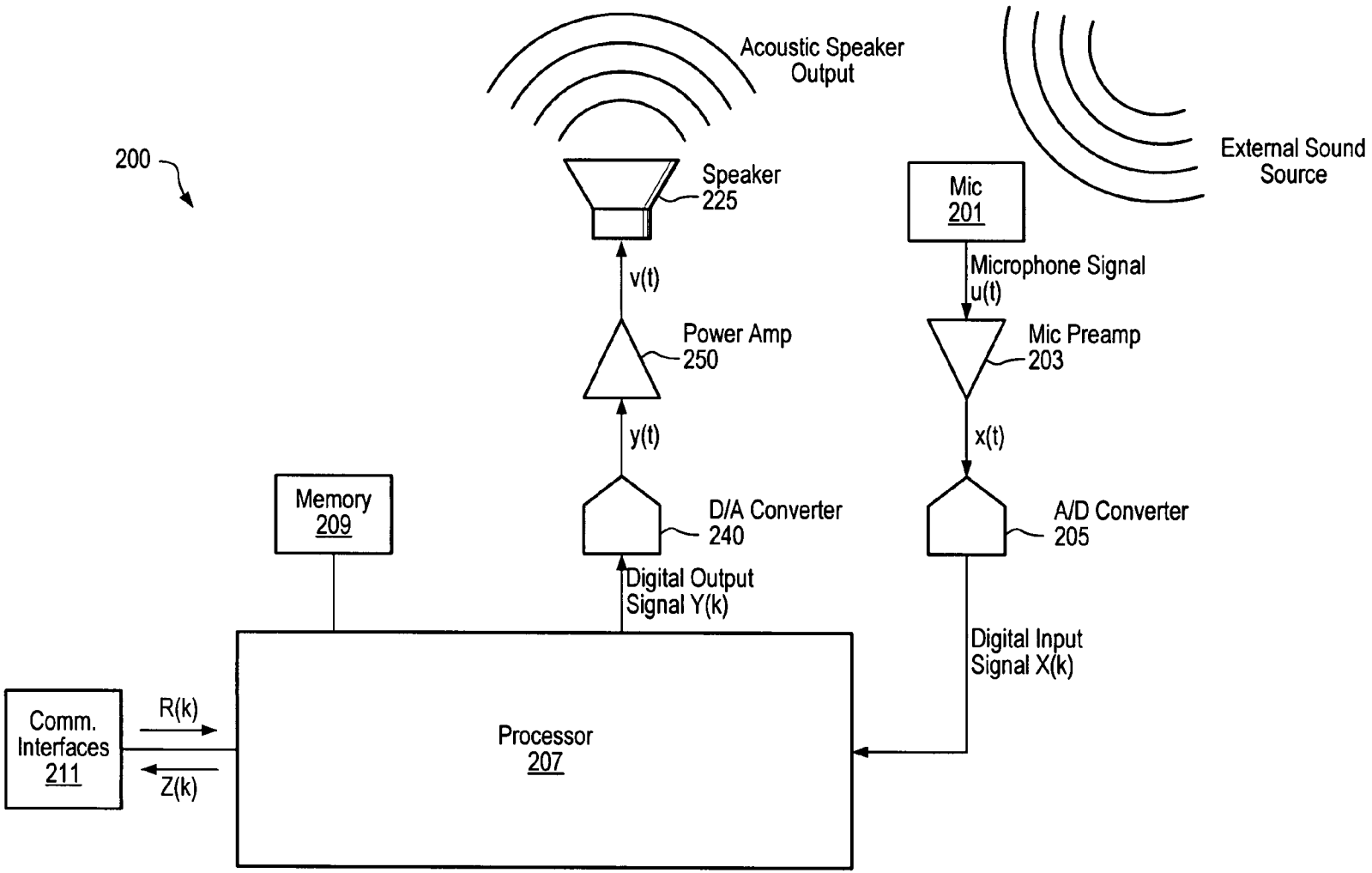
FIG. 1 illustrates one set of embodiments of a speakerphone system 200.

FIG. 1 illustrates a speakerphone 200 according to one set of embodiments. The speakerphone 200 may include a processor 207 (or a set of processors), memory 209, a set 211 of one or more communication interfaces, an input subsystem and an output subsystem.

The processor 207 is configured to read program instructions which have been stored in memory 209 and to execute the program instructions to execute any of the various methods described herein.

Memory 209 may include any of various kinds of semiconductor memory or combinations thereof. For example, in one embodiment, memory 209 may include a combination of Flash ROM and DDR SDRAM.

The input subsystem may include a microphone 201 (e.g., an electret microphone), a microphone preamplifier 203 and an analog-to-digital (A/D) converter 205. The microphone 201 receives an acoustic signal A(t) from the environment and converts the acoustic signal into an electrical signal u(t). (The variable t denotes time.) The microphone preamplifier 203 amplifies the electrical signal u(t) to produce an amplified signal x(t). The A/D converter samples the amplified signal x(t) to generate digital input signal X(k). The digital input signal X(k) is provided to processor 207.

In some embodiments, the A/D converter may be configured to sample the amplified signal x(t) at least at the Nyquist rate for speech signals. In other embodiments, the A/D converter may be configured to sample the amplified signal x(t) at least at the Nyquist rate for audio signals.

Processor 207 may operate on the digital input signal X(k) to remove various sources of noise, and thus, generate a corrected microphone signal Z(k). The processor 207 may send the corrected microphone signal Z(k) to one or more remote devices (e.g., a remote speakerphone) through one or more of the set 211 of communication interfaces.

The set 211 of communication interfaces may include a number of interfaces for communicating with other devices (e.g., computers or other speakerphones) through well-known communication media. For example, in various embodiments, the set 211 includes a network interface (e.g., an Ethernet bridge), an ISDN interface, a PSTN interface, or, any combination of these interfaces.

The speakerphone 200 may be configured to communicate with other speakerphones over a network (e.g., an Internet Protocol based network) using the network interface. In one embodiment, the speakerphone 200 is configured so multiple speakerphones, including speakerphone 200, may be coupled together in a daisy chain configuration.

The output subsystem may include a digital-to-analog (D/A) converter 240, a power amplifier 250 and a speaker 225. The processor 207 may provide a digital output signal Y(k) to the D/A converter 240. The D/A converter 240 converts the digital output signal Y(k) to an analog signal y(t). The power amplifier 250 amplifies the analog signal y(t) to generate an amplified signal v(t). The amplified signal v(t) drives the speaker 225. The speaker 225 generates an acoustic output signal in response to the amplified signal v(t).

Processor 207 may receive a remote audio signal R(k) from a remote speakerphone through one of the communication interfaces and mix the remote audio signal R(k) with any locally generated signals (e.g., beeps or tones) in order to generate the digital output signal Y(k). Thus, the acoustic signal radiated by speaker 225 may be a replica of the acoustic signals (e.g., voice signals) produced by remote conference participants situated near the remote speakerphone.

In one alternative embodiment, the speakerphone may include circuitry external to the processor 207 to perform the mixing of the remote audio signal R(k) with any locally generated signals.

In general, the digital input signal X(k) represents a superposition of contributions due to:

- acoustic signals (e.g., voice signals) generated by one or more persons (e.g., conference participants) in the environment of the speakerphone 200, and reflections of these acoustic signals off of acoustically reflective surfaces in the environment;
- acoustic signals generated by one or more noise sources (such as fans and motors, automobile traffic and fluorescent light fixtures) and reflections of these acoustic signals off of acoustically reflective surfaces in the environment; and
- the acoustic signal generated by the speaker 225 and the reflections of this acoustic signal off of acoustically reflective surfaces in the environment.

Processor 207 may be configured to execute software including an automatic echo cancellation (AEC) module.

The AEC module attempts to estimate the sum C(k) of the contributions to the digital input signal X(k) due to the acoustic signal generated by the speaker and a number of its reflections, and, to subtract this sum C(k) from the digital input signal X(k) so that the corrected microphone signal Z(k) may be a higher quality representation of the acoustic signals generated by the conference participants.

In one set of embodiments, the AEC module may be configured to perform many (or all) of its operations in the frequency domain instead of in the time domain. Thus, the AEC module may:

- estimate the Fourier spectrum C(ω) of the signal C(k) instead of the signal C(k) itself, and
- subtract the spectrum C(ω) from the spectrum X(ω) of the input signal X(k) in order to obtain a spectrum Z(ω).

An inverse Fourier transform may be performed on the spectrum Z(ω) to obtain the corrected microphone signal Z(k). As used herein, the "spectrum" of a signal is the Fourier transform (e.g., the FFT) of the signal.

In order to estimate the spectrum C(ω), the AEC module may operate on:

- the spectrum Y(ω) of a set of samples of the output signal Y(k),
- the spectrum X(ω) of a set of samples of the input signal X(k), and
- modeling information $I_M$ describing the input-output behavior of the system elements (or combinations of system elements) between the circuit nodes corresponding to signals Y(k) and X(k).

For example, the modeling information $I_M$ may include:

(a) a gain of the D/A converter 240;
(b) a gain of the power amplifier 250;
(c) an input-output model for the speaker 225;
(d) parameters characterizing a transfer function for the direct path and reflected path transmissions between the output of speaker 225 and the input of microphone 201;
(e) a transfer function of the microphone 201;
(f) a gain of the preamplifier 203;
(g) a gain of the A/D converter 205.

Figure 2:
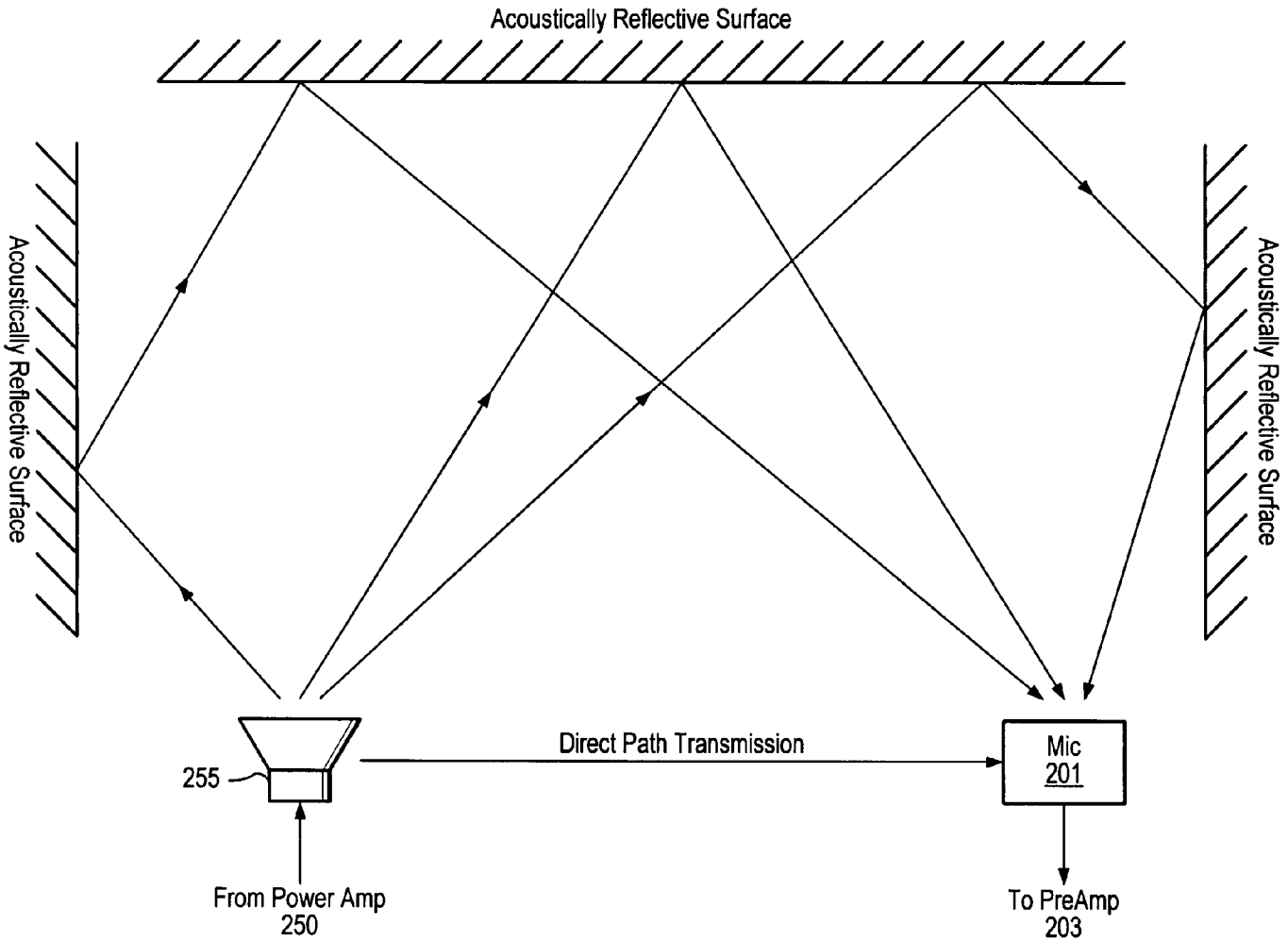
FIG. 2 illustrates a direct path transmission and three examples of reflected path transmissions between the speaker 255 and microphone 201.

The parameters (d) may be (or may include) propagation delay times for the direct path transmission and a set of the reflected path transmissions between the output of speaker 225 and the input of microphone 201. FIG. 2 illustrates the direct path transmission and three reflected path transmission examples.

In some embodiments, the input-output model for the speaker may be (or may include) a nonlinear Volterra series model, e.g., a Volterra series model of the form:

$$f_S(k) = \sum_{i=0}^{N_a-1} a_i v(k-i) + \sum_{i=0}^{N_b-1} \sum_{j=0}^{M_b-1} b_{ij} v(k-i) \cdot v(k-j), \tag{1}$$

where v(k) represents a discrete-time version of the speaker's input signal, where $f_s(k)$ represents a discrete-time version of the speaker's acoustic output signal, where $N_a$, $N_b$ and $M_b$ are positive integers. For example, in one embodiment, $N_a=8$, $N_b=3$ and $M_b=2$. Expression (1) has the form of a quadratic polynomial. Other embodiments using higher order polynomials are contemplated.

In alternative embodiments, the input-output model for the speaker is a transfer function (or equivalently, an impulse response).

The AEC module may compute an update for the parameters (d) based on the output spectrum Y(ω), the input spectrum X(ω), and at least a subset of the modeling information $I_M$ (possibly including previous values of the parameters (d)), and then, compute the compensation spectrum C(ω) using the output spectrum Y(ω) and the modeling information $I_M$ (including the updated values of the parameters (d)).

In those embodiments where the speaker input-output model is a nonlinear model (such as a Volterra series model), the AEC module may be able to converge more quickly and/or achieve greater accuracy in its estimation of the direct path and reflected path delay times because it will have access to a more accurate representation of the actual acoustic output of the speaker than in those embodiments where linear model (e.g., transfer function) is used to model the speaker.

In some embodiments, the AEC module may employ one or more computational algorithms that are well known in the field of echo cancellation.

The modeling information $I_M$ (or certain portions of the modeling information $I_M$) may be initially determined by measurements performed at a testing facility prior to sale or distribution of the speakerphone 200. Furthermore, certain portions of the modeling information $I_M$ (e.g., those portions that are likely to change over time) may be repeatedly updated based on operations performed during the lifetime of the speakerphone 200.

In one embodiment, an update to the modeling information $I_M$ may be based on samples of the input signal X(k) and samples of the output signal Y(k) captured during periods of time when the speakerphone is not being used to conduct a conversation.

In another embodiment, an update to the modeling information $I_M$ may be based on samples of the input signal X(k) and samples of the output signal Y(k) captured while the speakerphone 200 is being used to conduct a conversation.

In yet another embodiment, both kinds of updates to the modeling information $I_M$ may be performed.

Updating Modeling Information Based on Offline Calibration Experiments

In one set of embodiments, the processor 207 may be programmed to update the modeling information $I_M$ during a period of time when the speakerphone 200 is not being used to conduct a conversation.

The processor 207 may wait for a period of relative silence in the acoustic environment. For example, if the average power in the input signal X(k) stays below a certain threshold for a certain minimum amount of time, the processor 207 may reckon that the acoustic environment is sufficiently silent for a calibration experiment. The calibration experiment may be performed as follows.

The processor 207 may output a known noise signal as the digital output signal Y(k). In some embodiments, the noise signal may be a burst of maximum-length-sequence noise, followed by a period of silence. For example, in one embodiment, the noise signal burst may be approximately 2-2.5 seconds long and the following silence period may be approximately 5 seconds long.

The processor 207 may capture a block $B_X$ of samples of the digital input signal X(k) in response to the noise signal transmission. The block $B_X$ may be sufficiently large to capture the response to the noise signal and a sufficient number of its reflections for a maximum expected room size.

The block $B_X$ of samples may be stored into a temporary buffer, e.g., a buffer which has been allocated in memory 209.

The processor 207 computes a Fast Fourier Transform (FFT) of the captured block $B_X$ of input signal samples X(k) and an FFT of a corresponding block $B_Y$ of samples of the known noise signal Y(k), and computes an overall transfer function H(ω) for the current experiment according to the relation $$H(\omega)=FFT(B_X)/FFT(B_Y), \tag{2}$$

where ω denotes angular frequency. The processor may make special provisions to avoid division by zero.

The processor 207 may operate on the overall transfer function H(ω) to obtain a midrange sensitivity value $s_1$ as follows.

The midrange sensitivity value $s_1$ may be determined by computing an A-weighted average of the overall transfer function H(ω):

$$s_1=\mathrm{SUM}[H(\omega)A(\omega),\ \omega \text{ ranging from zero to } 2\pi]. \tag{3}$$

In some embodiments, the weighting function A(ω) may be designed so as to have low amplitudes:

at low frequencies where changes in the overall transfer function due to changes in the properties of the speaker are likely to be expressed, and at high frequencies where changes in the overall transfer function due to material accumulation on the microphone diaphragm is likely to be expressed.

Figure 3:
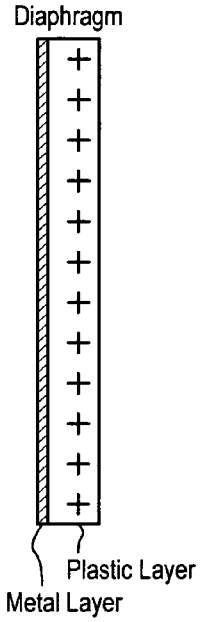
FIG. 3 illustrates a diaphragm of an electret microphone.

The diaphragm of an electret microphone is made of a flexible and electrically non-conductive material such as plastic (e.g., Mylar) as suggested in FIG. 3. Charge (e.g., positive charge) is deposited on one side of the diaphragm at the time of manufacture. A layer of metal may be deposited on the other side of the diaphragm.

Figure 4A:
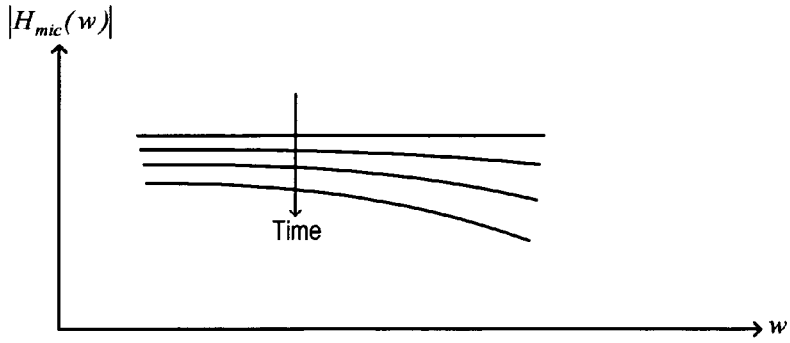
FIG. 4A illustrates the change over time of a microphone transfer function.

As the microphone ages, the deposited charge slowly dissipates, resulting in a gradual loss of sensitivity over all frequencies. Furthermore, as the microphone ages material such as dust and smoke accumulates on the diaphragm, making it gradually less sensitive at high frequencies. The summation of the two effects implies that the amplitude of the microphone transfer function $|H_{mic}(\omega)|$ decreases at all frequencies, but decreases faster at high frequencies as suggested by FIG. 4A. If the speaker were ideal (i.e., did not change its properties over time), the overall transfer function H(ω) would manifest the same kind of changes over time.

Figure 4B:
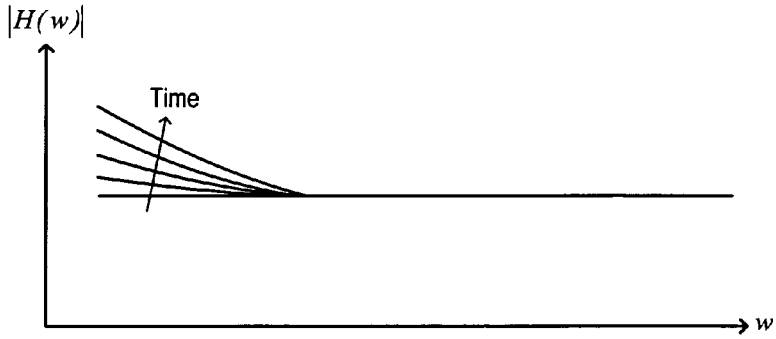
FIG. 4B illustrates the change over time of the overall transfer function due to changes in the properties of the speaker over time under the assumption of an ideal microphone.

The speaker 225 includes a cone and a surround coupling the cone to a frame. The surround is made of a flexible material such as butyl rubber. As the surround ages it becomes more compliant, and thus, the speaker makes larger excursions from its quiescent position in response to the same current stimulus. This effect is more pronounced at lower frequencies and negligible at high frequencies. In addition, the longer excursions at low frequencies implies that the vibrational mechanism of the speaker is driven further into the nonlinear regime. Thus, if the microphone were ideal (i.e., did not change its properties over time), the amplitude of the overall transfer function H(ω) in expression (2) would increase at low frequencies and remain stable at high frequencies, as suggested by FIG. 4B.

The actual change to the overall transfer function H(ω) over time is due to a combination of affects including the speaker aging mechanism and the microphone aging mechanism just described.

In addition to the sensitivity value $s_1$, the processor 207 may compute a lowpass sensitivity value $s_2$ and a speaker related sensitivity $s_3$ as follows. The lowpass sensitivity factor $s_2$ may be determined by computing a lowpass weighted average of the overall transfer function H(ω):

$$s_2=\mathrm{SUM}[H(\omega)L(\omega),\ \omega \text{ ranging from zero to } 2\pi]. \tag{4}$$

Figure 5:
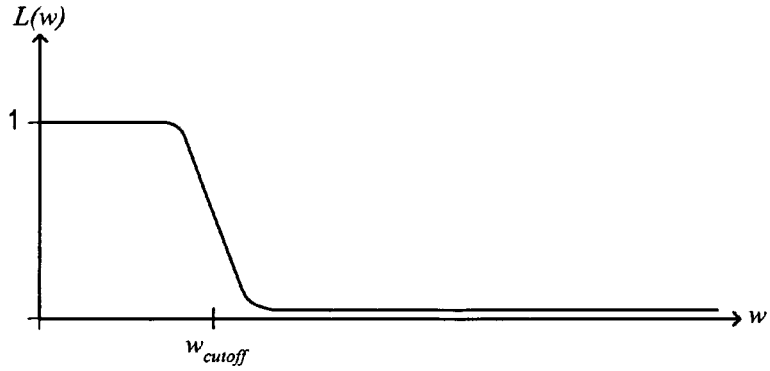
FIG. 5 illustrates a lowpass weighting function L(ω).

The lowpass weighting function L(ω) equals is equal (or approximately equal) to one at low frequencies and transitions towards zero in the neighborhood of a cutoff frequency. In one embodiment, the lowpass weighting function may smoothly transition to zero as suggested in FIG. 5.

The processor 207 may compute the speaker-related sensitivity value $s_3$ according to the expression:

$$s_3=s_2-s_1.$$

The processor 207 may maintain sensitivity averages $S_1$, $S_2$ and $S_3$ corresponding to the sensitivity values $s_1$, $s_2$ and $s_3$ respectively. The average $S_i$, i=1, 2, 3, represents the average of the sensitivity value $s_i$ from past performances of the calibration experiment.

Furthermore, processor 207 may maintain averages $A_i$ and $B_{ij}$ corresponding respectively to the coefficients $a_i$ and $b_{ij}$ in the Volterra series speaker model. After computing sensitivity value $s_3$, the processor may compute current estimates for the coefficients $b_{ij}$ by performing an iterative search. Any of a wide variety of known search algorithms may be used to perform this iterative search.

In each iteration of the search, the processor may select values for the coefficients $b_{ij}$ and then compute an estimated input signal $X_{EST}(k)$ based on:

the block $B_Y$ of samples of the transmitted noise signal Y(k);

the gain of the D/A converter 240 and the gain of the power amplifier 250;

the modified Volterra series expression $$f_S(k) = c\sum_{i=0}^{N_a-1} A_i v(k-i) + \sum_{i=0}^{N_b-1}\sum_{j=0}^{M_b-1} b_{ij} v(k-i)\cdot v(k-j), \tag{5}$$

where c is given by $c=s_3/S_3$;

the parameters characterizing the transfer function for the direct path and reflected path transmissions between the output of speaker 225 and the input of microphone 201;

the transfer function of the microphone 201;

the gain of the preamplifier 203; and the gain of the A/D converter 205.

The processor may compute the energy of the difference between the estimated input signal $X_{EST}(k)$ and the block $B_X$ of actually received input samples X(k). If the energy value is sufficiently small, the iterative search may terminate. If the energy value is not sufficiently small, the processor may select a new set of values for the coefficients $b_{ij}$, e.g., using knowledge of the energy values computed in the current iteration and one or more previous iterations.

The scaling of the linear terms in the modified Volterra series expression (5) by factor c serves to increase the probability of successful convergence of the $b_{ij}$.

After having obtained final values for the coefficients $b_{ij}$, the processor 207 may update the average values $B_{ij}$ according to the relations:

$$B_{ij} \leftarrow k_{ij}B_{ij} + (1-k_{ij})b_{ij}, \tag{6}$$

where the values $k_{ij}$ are positive constants between zero and one.

In one embodiment, the processor 207 may update the averages $A_i$ according to the relations:

$$A_i \leftarrow g_i A_i + (1-g_i)(cA_i), \tag{7}$$

where the values $g_i$ are positive constants between zero and one.

In an alternative embodiment, the processor may compute current estimates for the Volterra series coefficients $a_i$ based on another iterative search, this time using the Volterra expression:

$$f_S(k) = \sum_{i=0}^{N_a-1} a_i v(k-i) + \sum_{i=0}^{N_b-1}\sum_{j=0}^{M_b-1} B_{ij} v(k-i)\cdot v(k-j). \tag{8A}$$

After having obtained final values for the coefficients $a_i$, the processor may update the averages $A_i$ according the relations:

$$A_i \leftarrow g_i A_i + (1-g_i)a_i. \tag{8B}$$

The processor may then compute a current estimate $T_{mic}$ of the microphone transfer function based on an iterative search, this time using the Volterra expression:

$$f_S(k) = \sum_{i=0}^{N_a-1} A_i v(k-i) + \sum_{i=0}^{N_b-1}\sum_{j=0}^{M_b-1} B_{ij} v(k-i)\cdot v(k-j). \tag{9}$$

After having obtained a current estimate $T_{mic}$ for the microphone transfer function, the processor may update an average microphone transfer function $H_{mic}$ based on the relation:

$$H_{mic}(\omega) \leftarrow k_m H_{mic}(\omega) + (1-k_m)T_{mic}(\omega), \tag{10}$$

where $k_m$ is a positive constant between zero and one.

Furthermore, the processor may update the average sensitivity values $S_1$, $S_2$ and $S_3$ based respectively on the currently computed sensitivities $s_1$, $s_2$, $s_3$, according to the relations:

$$S_1 \leftarrow h_1 S_1 + (1-h_1)s_1, \tag{11}$$

$$S_2 \leftarrow h_2 S_2 + (1-h_2)s_2, \tag{12}$$

$$S_3 \leftarrow h_3 S_3 + (1-h_3)s_3, \tag{13}$$

where $h_1$, $h_2$, $h_3$ are positive constants between zero and one.

In the discussion above, the average sensitivity values, the Volterra coefficient averages $A_i$ and $B_{ij}$ and the average microphone transfer function $H_{mic}$ are each updated according to an IIR filtering scheme. However, other filtering schemes are contemplated such as FIR filtering (at the expense of storing more past history data), various kinds of nonlinear filtering, etc.

In one set of embodiments, a system (e.g., a speakerphone or a videoconferencing system) may include a microphone, a speaker, memory and a processor, e.g., as illustrated in FIG. 1. The memory may be configured to store program instructions and data. The processor is configured to read and execute the program instructions from the memory. The program instructions are executable by the processor to:

(a) output a stimulus signal (e.g., a noise signal) for transmission from the speaker;

(b) receive an input signal from the microphone, corresponding to the stimulus signal and its reverb tail;

(c) compute a midrange sensitivity and a lowpass sensitivity for a spectrum of the input signal;

(d) subtract the midrange sensitivity from the lowpass sensitivity to obtain a speaker-related sensitivity;

(e) perform an iterative search for current values of parameters of an input-output model for the speaker using the input signal spectrum, a spectrum of the stimulus signal, the speaker-related sensitivity; and (f) update averages of the parameters of the speaker input-output model using the current values obtained in (e).

The parameter averages of the speaker input-output model are usable to perform echo cancellation on other input signals.

The input-output model of the speaker may be a nonlinear model, e.g., a Volterra series model.

Furthermore, the program instructions may be executable by the processor to:

perform an iterative search for a current transfer function of the microphone using the input signal spectrum, the spectrum of the stimulus signal, and the current values; and update an average microphone transfer function using the current transfer function.

The average transfer function is also usable to perform said echo cancellation on said other input signals.

Figure 6A:
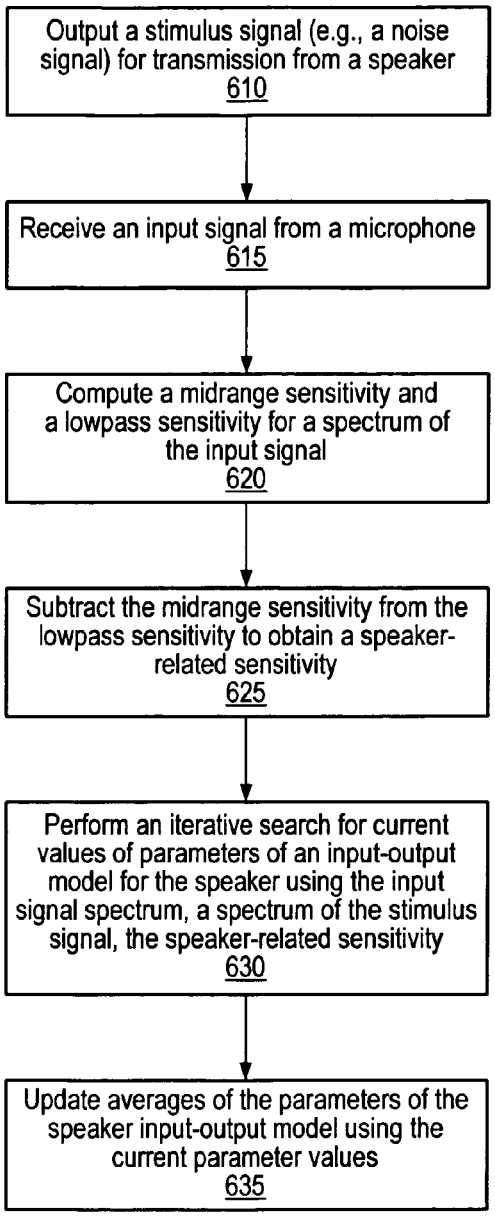
FIG. 6A illustrates one set of embodiments of a method for performing offline self calibration.

In another set of embodiments, as illustrated in FIG. 6A, a method for performing self calibration may involve the following steps:

(a) outputting a stimulus signal (e.g., a noise signal) for transmission from a speaker (as indicated at step 610);

(b) receiving an input signal from a microphone, corresponding to the stimulus signal and its reverb tail (as indicated at step 615);

(c) computing a midrange sensitivity and a lowpass sensitivity for a spectrum of the input signal (as indicated at step 620);

(d) subtracting the midrange sensitivity from the lowpass sensitivity to obtain a speaker-related sensitivity (as indicated at step 625);

(e) performing an iterative search for current values of parameters of an input-output model for the speaker using the input signal spectrum, a spectrum of the stimulus signal, the speaker-related sensitivity (as indicated at step 630); and (f) updating averages of the parameters of the speaker input-output model using the current parameter values (as indicated at step 635).

The parameter averages of the speaker input-output model are usable to perform echo cancellation on other input signals.

The input-output model of the speaker may be a nonlinear model, e.g., a Volterra series model.

Updating Modeling Information Based on Online Data Gathering

In one set of embodiments, the processor 207 may be programmed to update the modeling information $I_M$ during periods of time when the speakerphone 200 is being used to conduct a conversation.

Suppose speakerphone 200 is being used to conduct a conversation between one or more persons situated near the speakerphone 200 and one or more other persons situated near a remote speakerphone (or videoconferencing system). In this case, the processor 207 essentially sends out the remote audio signal R(k), provided by the remote speakerphone, as the digital output signal Y(k). It would probably be offensive to the local persons if the processor 207 interrupted the conversation to inject a noise transmission into the digital output stream Y(k) for the sake of self calibration. Thus, the processor 207 may perform its self calibration based on samples of the output signal Y(k) while it is "live", i.e., carrying the audio information provided by the remote speakerphone. The self-calibration may be performed as follows.

The processor 207 may start storing samples of the output signal Y(k) into an first FIFO and storing samples of the input signal X(k) into a second FIFO, e.g., FIFOs allocated in memory 209. Furthermore, the processor may scan the samples of the output signal Y(k) to determine when the average power of the output signal Y(k) exceeds (or at least reaches) a certain power threshold. The processor 207 may terminate the storage of the output samples Y(k) into the first FIFO in response to this power condition being satisfied. However, the processor may delay the termination of storage of the input samples X(k) into the second FIFO to allow sufficient time for the capture of a full reverb tail corresponding to the output signal Y(k) for a maximum expected room size.

The processor 207 may then operate, as described above, on a block $B_Y$ of output samples stored in the first FIFO and a block $B_X$ of input samples stored in the second FIFO to compute:

(1) current estimates for Volterra coefficients $a_i$ and $b_{ij}$;

(2) a current estimate $T_{mic}$ for the microphone transfer function;

(3) updates for the average Volterra coefficients $A_i$ and $B_{ij}$; and (4) updates for the average microphone transfer function $H_{mic}$.

Because the block $B_X$ of received input sample is captured while the speakerphone 200 is being used to conduct a live conversation, the block $B_X$ is very likely to contain interference (from the point of view of the self calibration) due to the voices of persons in the environment of the microphone 201. Thus, in updating the average values with the respective current estimates, the processor may strongly weight the past history contribution, i.e., much more strongly than in those situations described above where the self-calibration is performed during periods of silence in the external environment.

In some embodiments, a system (e.g., a speakerphone or a videoconferencing system) may include a microphone, a speaker, memory and a processor, e.g., as illustrated in FIG. 1. The memory may be configured to store program instructions and data. The processor is configured to read and execute the program instructions from the memory. The program instructions are executable by the processor to:

(a) provide an output signal for transmission from the speaker, wherein the output signal carries live signal information from a remote source;

(b) receive an input signal from the microphone, corresponding to the output signal and its reverb tail;

(c) compute a midrange sensitivity and a lowpass sensitivity for a spectrum of the input signal;

(d) subtract the midrange sensitivity from the lowpass sensitivity to obtain a speaker-related sensitivity;

(e) perform an iterative search for current values of parameters of an input-output model for the speaker using the input signal spectrum, a spectrum of the output signal, the speaker-related sensitivity; and (f) update averages of the parameters of the speaker input-output model using the current values obtained in (e).

The parameter averages of the speaker input-output model are usable to perform echo cancellation on other input signals.

The input-output model of the speaker is a nonlinear model, e.g., a Volterra series model.

Furthermore, the program instructions may be executable by the processor to:

perform an iterative search for a current transfer function of the microphone using the input signal spectrum, the spectrum of the output signal, and the current values; and update an average microphone transfer function using the current transfer function.

The current transfer function is usable to perform said echo cancellation on said other input signals.

Figure 6B:
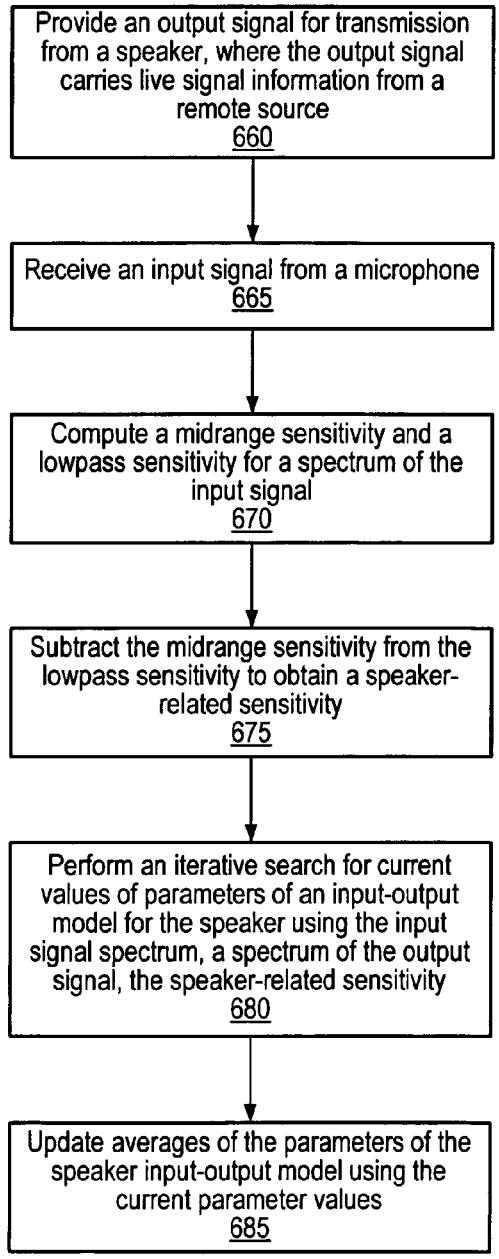
FIG. 6B illustrates one set of embodiments of a method for performing "live" self calibration.

In one set of embodiments, as illustrated in FIG. 6B, a method for performing self calibration may involve:

(a) providing an output signal for transmission from a speaker, wherein the output signal carries live signal information from a remote source (as indicated at step 660);

(b) receiving an input signal from a microphone, corresponding to the output signal and its reverb tail (as indicated at step 665);

(c) computing a midrange sensitivity and a lowpass sensitivity for a spectrum of the input signal (as indicated at step 670);

(d) subtracting the midrange sensitivity from the lowpass sensitivity to obtain a speaker-related sensitivity (as indicated at step 675);

(e) performing an iterative search for current values of parameters of an input-output model for the speaker using the input signal spectrum, a spectrum of the output signal, the speaker-related sensitivity (as indicated at step 680); and (f) updating averages of the parameters of the speaker input-output model using the current parameter values (as indicated at step 685).

The parameter averages of the speaker input-output model are usable to perform echo cancellation on other input signals.

Furthermore, the method may involve:

performing an iterative search for a current transfer function of the microphone using the input signal spectrum, the spectrum of the output signal, and the current values; and updating an average microphone transfer function using the current transfer function.

The current transfer function is also usable to perform said echo cancellation on said other input signals.

Plurality of Microphones

In some embodiments, the speakerphone 200 may include $N_M$ input channels, where $N_M$ is two or greater. Each input channel $IC_j$, j=1, 2, 3, . . . , $N_M$ may include a microphone $M_j$, a preamplifier $PA_j$, and an A/D converter $ADC_j$. The description given above of various embodiments in the context of one input channel naturally generalizes to $N_M$ input channels.

Let $u_j(t)$ denote the analog electrical signal captured by microphone $M_j$.

Figure 7:
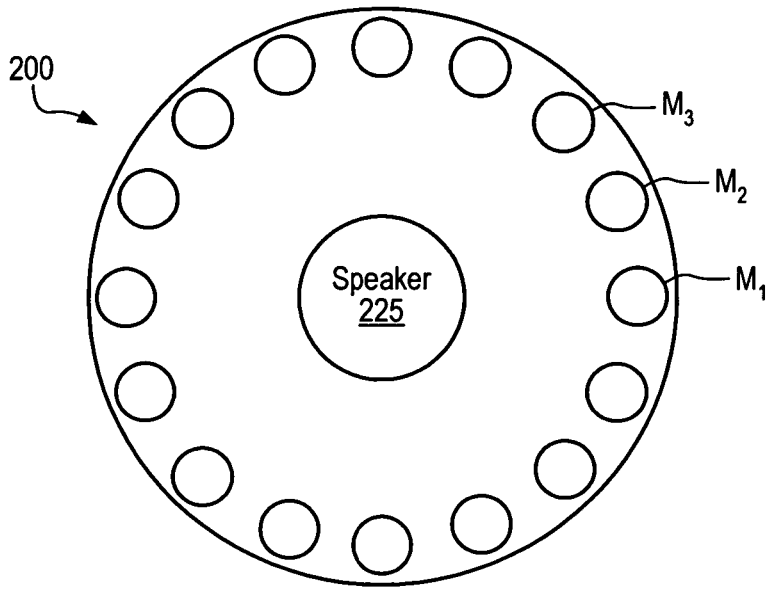
FIG. 7 illustrates one embodiment of speakerphone having a circular array of microphones.

In one group of embodiments, the $N_M$ microphones may be arranged in a circular array with the speaker 225 situated at the center of the circle as suggested by the physical realization (viewed from above) illustrated in FIG. 7. Thus, the delay time $\tau_0$ of the direct path transmission between the speaker and each microphone is approximately the same for all microphones. In one embodiment of this group, the microphones may all be omni-directional microphones having approximately the same transfer function. In this embodiment, the speakerphone 200 may apply the same correction signal e(t) to each microphone signal $u_j(t)$: $r_j(t)=u_j(t)-e(t)$ for j=1, 2, 3, . . . , $N_M$. The use of omni-directional microphones makes it much easier to achieve (or approximate) the condition of approximately equal microphone transfer functions.

Preamplifier $PA_j$ amplifies the difference signal $r_j(t)$ to generate an amplified signal $x_j(t)$. $ADC_j$ samples the amplified signal $x_j(t)$ to obtain a digital input signal $X_j(k)$.

Processor 207 may receive the digital input signals $X_j(k)$, j=1, 2, . . . , $N_M$.

In one embodiment, $N_M$ equals 16. However, a wide variety of other values are contemplated for $N_M$.

Hybrid Beamforming

In one set of embodiments, processor 207 may operate on the set of digital input signals $X_j(k)$, j=1, 2, . . . , $N_M$ to generate a resultant signal D(k) that represents the output of a highly directional virtual microphone pointed in a target direction. The virtual microphone is configured to be much more sensitive in an angular neighborhood of the target direction than outside this angular neighborhood. The virtual microphone allows the speakerphone to "tune in" on any acoustic sources in the angular neighborhood and to "tune out" (or suppress) acoustic sources outside the angular neighborhood.

According to one methodology, the processor 207 may generate the resultant signal D(k) by:

computing a Fourier transform of the digital input signals $X_j(k)$, j=1, 2, . . . , $N_M$, to generate corresponding input spectra $X_j(f)$, j=1, 2, . . . , $N_M$, where f denotes frequency; and operating on the input spectra $X_j(f)$, j=1, 2, . . . , $N_M$ with virtual beams B(1), B(2), . . . , B($N_B$) to obtain respective beam formed spectra V(1), V(2), . . . , V($N_B$), where $N_B$ is greater than or equal to two;

adding (perhaps with weighting) the spectra V(1), V(2), . . . , V($N_B$) to obtain a resultant spectrum D(f);

inverse transforming the resultant spectrum D(f) to obtain the resultant signal D(k).

Each of the virtual beams B(i), i=1, 2, . . . , $N_B$ has an associated frequency range $$R(i)=[c_i,d_i]$$

and operates on a corresponding subset $S_i$ of the input spectra $X_j(f)$, j=1, 2, . . . , $N_M$. (To say that A is a subset of B does not exclude the possibility that subset A may equal set B.) The processor 207 may window each of the spectra of the subset $S_i$ with a window function $W_i$ corresponding to the frequency range R(i) to obtain windowed spectra, and, operate on the windowed spectra with the beam B(i) to obtain spectrum V(i). The window function $W_i$ may equal one inside the range R(i) and the value zero outside the range R(i). Alternatively, the window function $W_i$ may smoothly transition to zero in neighborhoods of boundary frequencies $c_i$ and $d_i$.

The union of the ranges R(1), R(2), . . . , R($N_B$) may cover the range of audio frequencies, or, at least the range of frequencies occurring in speech.

The ranges R(1), R(2), . . . , R($N_B$) includes a first subset of ranges that are above a certain frequency $f_{TR}$ and a second subset of ranges that are below the frequency $f_{TR}$. For example, in one embodiment, the frequency $f_{TR}$ may be approximately 550 Hz.

Each of the virtual beams B(i) that corresponds to a frequency range R(i) below the frequency $f_{TR}$ may be a beam of order L(i) formed from L(i)+1 of the input spectra $X_j(f)$, j=1, 2, . . . , $N_M$, where L(i) is an integer greater than or equal to one. The L(i)+1 spectra may correspond to L(i)+1 microphones of the circular array that are aligned (or approximately aligned) in the target direction.

Furthermore, each of the virtual beams B(i) that corresponds to a frequency range R(i) above the frequency $f_{TR}$ may have the form of a delay-and-sum beam. The delay-and-sum parameters of the virtual beam B(i) may be designed by beam forming design software. The beam forming design software may be conventional software known to those skilled in the art of beam forming. For example, the beam forming design software may be software that is available as part of MATLAB®.

Figure 8:
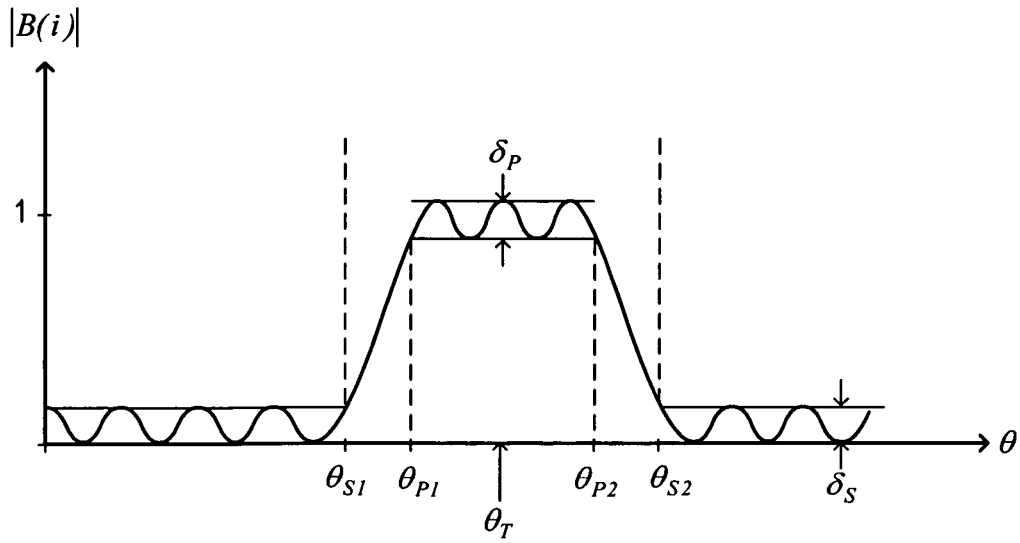
FIG. 8 illustrates an example of design parameters associated with the design of a beam B(i).

The beam forming design software may be directed to design an optimal delay-and-sum beam for beam B(i) at some frequency (e.g., the midpoint frequency) in the frequency range R(i) given the geometry of the circular array and beam constraints such as passband ripple $\delta_P$, stopband ripple $\delta_S$, passband edges $\theta_{P1}$ and $\theta_{P2}$, first stopband edge $\theta_{S1}$ and second stopband edge $\theta_{S2}$ as suggested by FIG. 8.

The beams corresponding to frequency ranges above the frequency $f_{TR}$ are referred to herein as "high end" beams. The beams corresponding to frequency ranges below the frequency $f_{TR}$ are referred to herein as "low end" beams. The virtual beams B(1), B(2), . . . , B($N_B$) may include one or more low end beams and one or more high end beams.

In some embodiments, the beam constraints may be the same for all high end beams B(i). The passband edges $\theta_{P1}$ and $\theta_{P2}$ may be selected so as to define an angular sector of size $360/N_M$ degrees (or approximately this size). The passband may be centered on the target direction $\theta_T$.

The delay-and-sum parameters for each high end beam and the parameters for each low end beam may be designed at a laboratory facility and stored into memory 209 prior to operation of the speakerphone 200. Since the microphone array is symmetric with respect to rotation through any multiple of $360/N_M$ degrees, the set of parameters designed for one target direction may be used for any of the $N_M$ target directions given by $k(360/N_M)$, k=0, 1, 2, . . . , $N_M-1$.

In one embodiment, the frequency $f_{TR}$ is 550 Hz,

R(1)=R(2)=[0.550 Hz],

L(1)=L(2)=2, and low end beam B(1) operates on three of the spectra $X_j(f)$, j=1, 2, . . . , $N_M$, and low end beam B(2) operates on a different three of the spectra $X_j(f)$, j=1, 2, . . . , $N_M$;

frequency ranges R(3), R(4), . . . , R($N_B$) are an ordered succession of ranges covering the frequencies from $f_{TR}$ up to a certain maximum frequency (e.g., the upper limit of audio frequencies, or, the upper limit of voice frequencies);

beams B(3), B(4), . . . , B($N_M$) are high end beams designed as described above.

Figure 9:
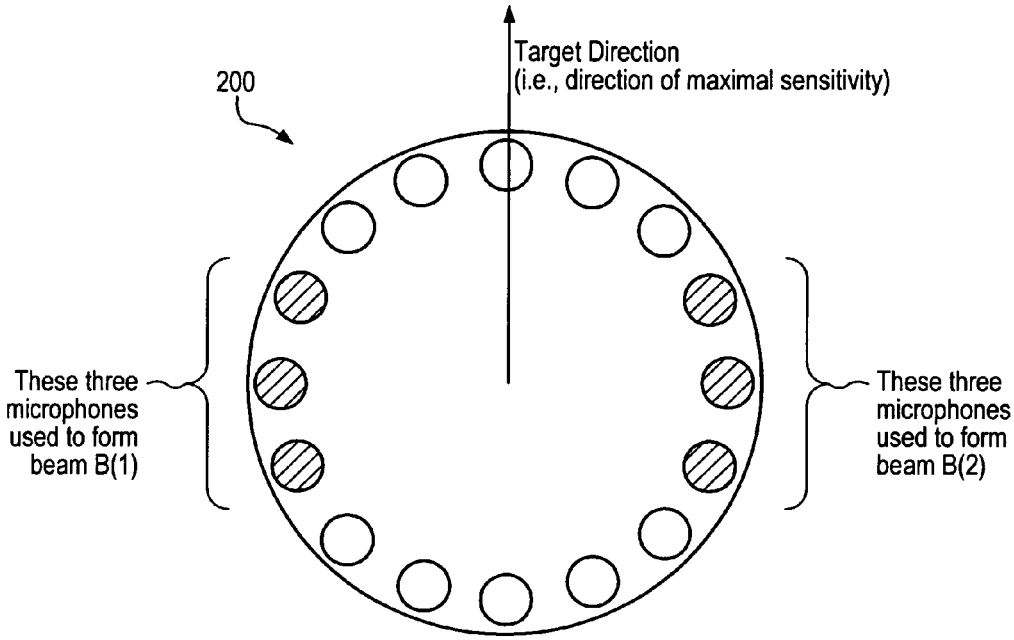
FIG. 9 illustrates two sets of three microphones aligned approximately in a target direction, each set being used to form a virtual beam.

FIG. 9 illustrates the three microphones (and thus, the three spectra) used by each of beams B(1) and B(2), relative to the target direction.

Figure 10:
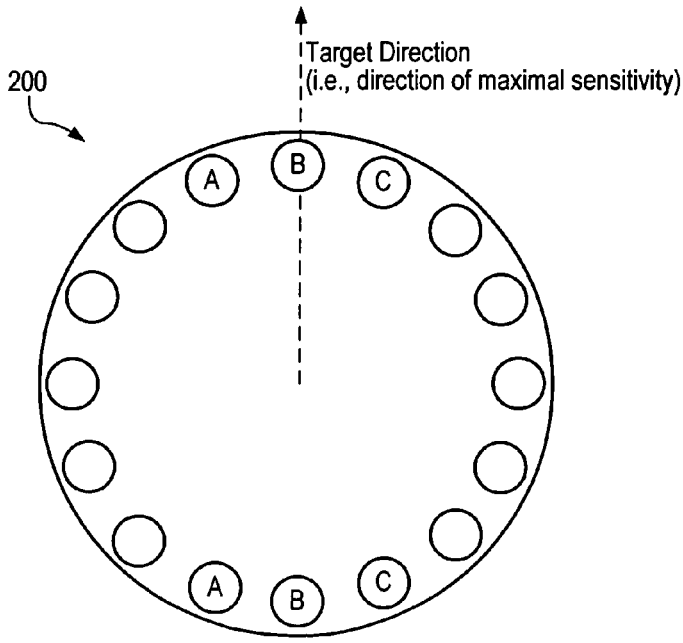
FIG. 10 illustrates three sets of two microphones aligned in a target direction, each set being used to form a virtual beam.

In another embodiment, the virtual beams B(1), B(2), . . . , B($N_B$) may include a set of low end beams of first order. FIG. 10 illustrates an example of three low end beams of first order. Each of the three low end beams may be formed using a pair of the input spectra $X_j(f)$, j=1, 2, . . . , $N_M$. For example, beam B(1) may be formed from the input spectra corresponding to the two "A" microphones. Beam B(2) may be formed form the input spectra corresponding to the two "B" microphones. Beam B(3) may be formed form the input spectra corresponding to the two "C" microphones.

Figure 11:
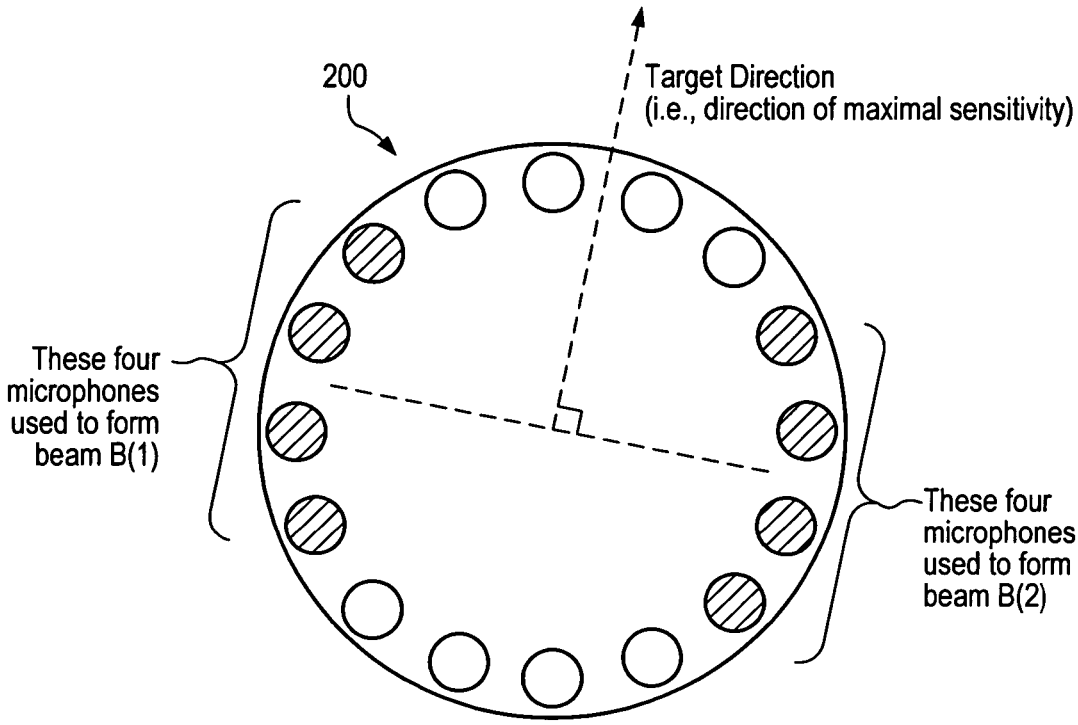
FIG. 11 illustrates two sets of four microphones aligned in a target direction, each set being used to form a virtual beam.

In yet another embodiment, the virtual beams B(1), B(2), . . . , B($N_B$) may include a set of low end beams of third order. FIG. 11 illustrates an example of two low end beams of third order. Each of the two low end beams may be formed using a set of four input spectra corresponding to four consecutive microphone channels that are approximately aligned in the target direction.

In one embodiment, the low order beams may include:

second order beams (e.g., a pair of second order beams as suggested in FIG. 9), each second order beam being associated with the range of frequencies less than $f_1$, where $f_1$ is less than $f_{TR}$; and third order beams (e.g., a pair of third order beams as suggested in FIG. 11), each third order beam being associated with the range of frequencies from $f_1$ to $f_{TR}$.

For example, $f_1$ may equal approximately 250 Hz.

In some embodiments, a system (e.g., a speakerphone or a videoconferencing system) may include a set of microphones, memory and a processor, e.g., as suggested in FIG. 1 and FIG. 7. The memory is configured to store program instructions and data. The processor is configured to read and execute the program instructions from the memory. The program instructions are executable by the processor to:

(a) receive an input signal corresponding to each of the microphones;

(b) transform the input signals into the frequency domain to obtain respective input spectra;

(c) operate on the input spectra with a set of virtual beams to obtain respective beam-formed spectra, wherein each of the virtual beams is associated with a corresponding frequency range and a corresponding subset of the input spectra, wherein each of the virtual beams operates on portions of input spectra of the corresponding subset of input spectra which have been band limited to the corresponding frequency range, wherein the virtual beams include one or more low end beams and one or more high end beams, wherein each of the low end beams is a beam of a corresponding integer order, wherein each of the high end beams is a delay-and-sum beam;

(d) compute a linear combination (e.g., a sum or a weighted sum) of the beam-formed spectra to obtain a resultant spectrum; and (e) inverse transform the resultant spectrum to obtain a resultant signal.

The program instructions are also executable by the processor to provide the resultant signal to a communication interface for transmission.

The set of microphones may be arranged in a circular array.

Figure 12:
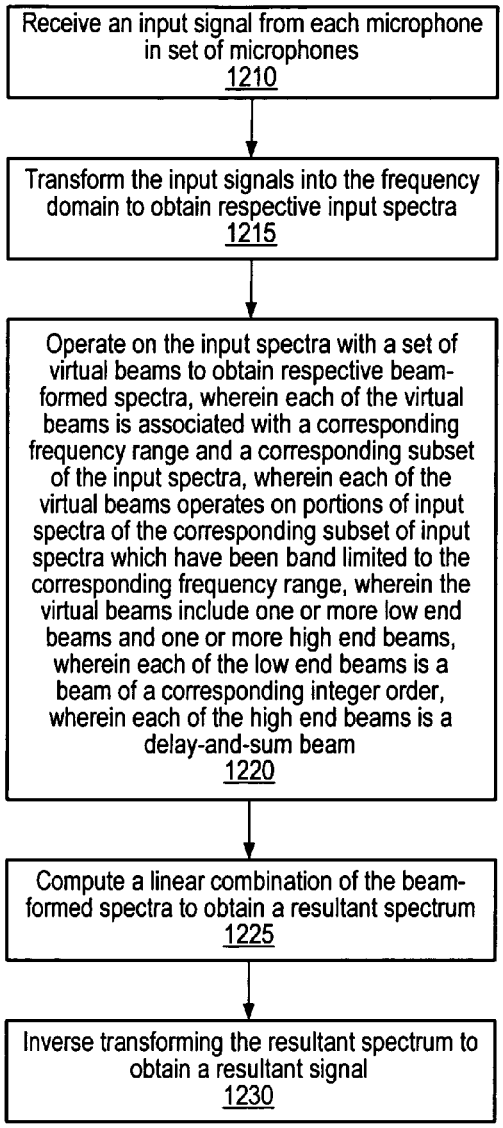
FIG. 12 illustrates one set of embodiments of a method for forming a hybrid beam.

In another set of embodiments, as illustrated in FIG. 12, a method for beam forming may involve:

(a) receiving an input signal from each microphone in set of microphones (as indicated at step 1210);

(b) transforming the input signals into the frequency domain to obtain respective input spectra (as indicated at step 1215);

(c) operating on the input spectra with a set of virtual beams to obtain respective beam-formed spectra, wherein each of the virtual beams is associated with a corresponding frequency range and a corresponding subset of the input spectra, wherein each of the virtual beams operates on portions of input spectra of the corresponding subset of input spectra which have been band limited to the corresponding frequency range, wherein the virtual beams include one or more low end beams and one or more high end beams, wherein each of the low end beams is a beam of a corresponding integer order, wherein each of the high end beams is a delay-and-sum beam (as indicated at step 1220);

(d) computing a linear combination (e.g., a sum or a weighted sum) of the beam-formed spectra to obtain a resultant spectrum (as indicated at step 1225); and (e) inverse transforming the resultant spectrum to obtain a resultant signal (as indicated at step 1230).

The resultant signal may be provided to a communication interface for transmission (e.g., to a remote speakerphone).

The set of microphones may be arranged in a circular array.

The high end beams may be designed using beam forming design software. Each of the high end beams may be designed subject to the same (or similar) beam constraints. For example, each of the high end beams may be constrained to have the same pass band width (i.e., main lobe width).

In yet another set of embodiments, a system may include a set of microphones, memory and a processor, e.g., as suggested in FIG. 1 and FIG. 7. The memory is configured to store program instructions and data. The processor is configured to read and execute the program instructions from the memory. The program instructions are executable by the processor to:

(a) receive an input signal from each of the microphones;

(b) operate on the input signals with a set of virtual beams to obtain respective beam-formed signals, wherein each of the virtual beams is associated with a corresponding frequency range and a corresponding subset of the input signals, wherein each of the virtual beams operates on versions of the input signals of the corresponding subset of input signals which have been band limited to the corresponding frequency range, wherein the virtual beams include one or more low end beams and one or more high end beams, wherein each of the low end beams is a beam of a corresponding integer order, wherein each of the high end beams is a delay-and-sum beam; and (c) compute a linear combination (e.g., a sum or a weighted sum) of the beam-formed signals to obtain a resultant signal.

The program instructions are executable by the processor to provide the resultant signal to a communication interface for transmission.

The set of microphones may be arranged in a circular array.

Figure 13:
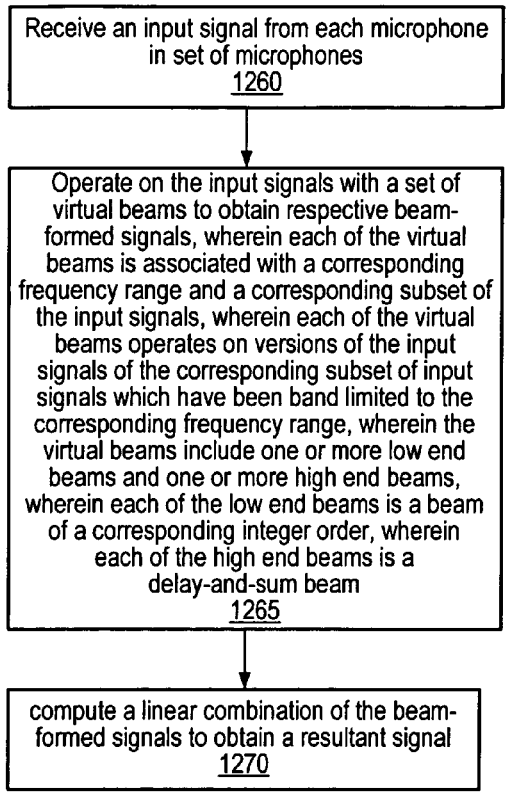
FIG. 13 illustrates another set of embodiments of a method for forming a hybrid beam.

In yet another set of embodiments, as illustrated in FIG. 13, a method for beam forming may involve:

(a) receiving an input signal from each microphone in a set of microphones;

(b) operating on the input signals with a set of virtual beams to obtain respective beam-formed signals, wherein each of the virtual beams is associated with a corresponding frequency range and a corresponding subset of the input signals, wherein each of the virtual beams operates on versions of the input signals of the corresponding subset of input signals which have been band limited to the corresponding frequency range, wherein the virtual beams include one or more low end beams and one or more high end beams, wherein each of the low end beams is a beam of a corresponding integer order, wherein each of the high end beams is a delay-and-sum beam; and (c) computing a linear combination (e.g., a sum or a weighted sum) of the beam-formed signals to obtain a resultant signal.

The resultant signal may be provided to a communication interface for transmission (e.g., to a remote speakerphone).

The set of microphones are arranged in a circular array.

The high end beams may be designed using beam forming design software. Each of the high end beams may be designed subject to the same (or similar) beam constraints. For example, each of the high end beams may be constrained to have the same pass band width (i.e., main lobe width).

CONCLUSION

Various embodiments may further include receiving, sending or storing program instructions and/or data implemented in accordance with the foregoing description upon a computer-accessible medium. Generally speaking, a computer-accessible medium may include storage media or memory media such as magnetic or optical media, e.g., disk or CD-ROM, volatile or non-volatile media such as RAM (e.g. SDRAM, DDR SDRAM, RDRAM, SRAM, etc.), ROM, etc. as well as transmission media or signals such as electrical, electromagnetic, or digital signals, conveyed via a communication medium such as network and/or a wireless link.

The various methods as illustrated in the Figures and described herein represent exemplary embodiments of methods. The methods may be implemented in software, hardware, or a combination thereof. The order of method may be changed, and various elements may be added, reordered, combined, omitted, modified, etc.

Various modifications and changes may be made as would be obvious to a person skilled in the art having the benefit of this disclosure. It is intended that the invention embrace all such modifications and changes and, accordingly, the above description to be regarded in an illustrative rather than a restrictive sense.

What is claimed is:

1. A system comprising:

a set of microphones;

memory that stores program instructions;

a processor configured to read and execute the program instructions from the memory, wherein the program instructions, when executed by the processor, cause the processor to:

(a) receive an input signal corresponding to each of the microphones;

(b) transform the input signals into the frequency domain to obtain respective input spectra;

(c) operate on the input spectra with a set of virtual beams to obtain respective beam-formed spectra, wherein each of the virtual beams is associated with a corresponding frequency range and a corresponding subset of the input spectra, wherein each of the virtual beams operates on portions of input spectra of the corresponding subset of input spectra which have been band limited to the corresponding frequency range, wherein the virtual beams include one or more low end beams and one or more high end beams, wherein each of the low end beams is a beam of a corresponding integer order, wherein each of the high end beams is a delay-and-sum beam;

(d) compute a linear combination of the beam-formed spectra to obtain a resultant spectrum; and (e) inverse transform the resultant spectrum to obtain a resultant signal.

2. The system of claim 1, wherein the program instructions, when executed by the processor, further cause the processor to: provide the resultant signal to a communication interface for transmission.

3. The system of claim 1, wherein the microphones of said set of microphones are arranged in a circular array.

4. The system of claim 1, wherein the union of the frequency ranges of the virtual beams covers the range of audio frequencies.

5. The system of claim 1, wherein the union of the frequency ranges of the virtual beams covers the range of voice frequencies.

6. The system of claim 1, wherein the one or more low end beams and the one or more high end beams are directed towards a target direction.

7. The system of claim 1, wherein the one or more low end beams include two low end beams of order two.

8. The system of claim 1, wherein the one or more low end beams include three low end beams of order one.

9. The system of claim 1, wherein the one or more low end beams include two low end beams of order three.

10. The system of claim 1, wherein the one or more high end beams include a plurality of high end beams, wherein the frequency ranges corresponding to the one or more low end beams are less than a predetermined frequency, wherein the frequency ranges corresponding to the high end beams are greater than the predetermined frequency, wherein the frequency ranges corresponding to the high end beams form an ordered succession that covers the frequencies from the predetermined frequency up to a maximum frequency.

11. The system of claim 1, wherein an angular passband of each of the high end beams is approximately 360/N degrees, where N is the number of microphones in the set of microphones.

12. A system comprising:

a set of microphones;

memory that stores program instructions;

a processor configured to read and execute the program instructions from the memory, wherein the program instructions, when executed by the processor, cause the processor to:

(a) receive an input signal from each of the microphones;

(b) operate on the input signals with a set of virtual beams to obtain respective beam-formed signals, wherein each of the virtual beams is associated with a corresponding frequency range and a corresponding subset of the input signals, wherein each of the virtual beams operates on versions of the input signals of the corresponding subset of input signals which have been band limited to the corresponding frequency range, wherein the virtual beams include one or more low end beams and one or more high end beams, wherein each of the low end beams is a beam of a corresponding integer order, wherein each of the high end beams is a delay-and-sum beam;

(c) compute a linear combination of the beam-formed signals to obtain a resultant signal.

13. The system of claim 12, wherein the program instructions, when executed by the processor, further cause the processor to: provide the resultant signal to a communication interface for transmission.

14. The system of claim 12, wherein the microphones of said set of microphones are arranged in a circular array.

15. A method comprising:

(a) receiving, by a processor, an input signal from each microphone in set of microphones;

(b) transforming, by, the processor, the input signals into the frequency domain to obtain respective input spectra;

(c) operating, by the processor, on the input spectra with a set of virtual beams to obtain respective beam-formed spectra, wherein each of the virtual beams is associated with a corresponding frequency range and a corresponding subset of the input spectra, wherein each of the virtual beams operates on portions of input spectra of the corresponding subset of input spectra which have been band limited to the corresponding frequency range, wherein the virtual beams include one or more low end beams and one or more high end beams, wherein each of the low end beams is a beam of a corresponding integer order, wherein each of the high end beams is a delay-and-sum beam;

(d) computing, by the processor, a linear combination of the beam-formed spectra to obtain a resultant spectrum; and (e) inverse transforming, by the processor, the resultant spectrum to obtain a resultant signal.

16. The method of claim 15 further comprising:

providing, by the processor, the resultant signal to a communication interface for transmission.

17. The method of claim 15, wherein the set of microphones are arranged in a circular array.

18. A method comprising:

(a) receiving, by a processor, an input signal from each microphone in a set of microphones;

(b) operating, by the processor, on the input signals with a set of virtual beams to obtain respective beam-formed signals, wherein each of the virtual beams is associated with a corresponding frequency range and a corresponding subset of the input signals, wherein each of the virtual beams operates on versions of the input signals of the corresponding subset of input signals which have been band limited to the corresponding frequency range, wherein the virtual beams include one or more low end beams and one or more high end beams, wherein each of the low end beams is a beam of a corresponding integer order, wherein each of the high end beams is a delay-and-sum beam; and (c) computing, by the processor a linear combination of the beam-formed signals to obtain a resultant signal.

19. The method of claim 18 further comprising:

providing, by the processor, the resultant signal to a communication interface for transmission.

20. The method of claim 18, wherein the set of microphones are arranged in a circular array.

* * * * *